US005987271A

United States Patent [19]

Regelsberger et al.

[11] Patent Number: 5,987,271

[45] Date of Patent: Nov. 16, 1999

[54] METHOD AND APPARATUS FOR CONTROL OF VARIABILITY IN CHARGE TO MASS RATIO IN A DEVELOPMENT STATION

[75] Inventors: Matthias H. Regelsberger, Rochester; David E. Hockey, Brockport; Jeffrey C. Blood, Webster; Kevin D. Lofftus, Rochester, all of N.Y.

[73] Assignee: Eastman Kodak Company, Rochester, N.Y.

[21] Appl. No.: 08/998,787

[22] Filed: Dec. 29, 1997

[51] Int. Cl.[6] ..... G03G 15/00

[52] U.S. Cl. ..... 399/58; 399/46; 399/49

[58] Field of Search ..... 399/46, 49, 50, 399/51, 53, 72, 30

[56] References Cited

U.S. PATENT DOCUMENTS

| | | | |
|---|---|---|---|
| 4,026,643 | 5/1977 | Bergman | 399/60 |
| 4,473,029 | 9/1984 | Fritz et al. | 399/236 |
| 4,546,060 | 10/1985 | Miskinis et al. | 430/108 |
| 4,875,078 | 10/1989 | Resch, III et al. | 399/61 |
| 5,235,388 | 8/1993 | Rimai et al. | 399/61 |
| 5,253,934 | 10/1993 | Potucek et al. | 347/237 |
| 5,257,039 | 10/1993 | Chung et al. | 347/237 |
| 5,300,960 | 4/1994 | Pham et al. | 347/130 |
| 5,315,352 | 5/1994 | Nakane et al. | 399/49 |
| 5,416,564 | 5/1995 | Thompson et al. | 399/27 |
| 5,649,266 | 7/1997 | Rushing | 399/59 |
| 5,678,131 | 10/1997 | Alexandrovich et al. | 399/60 X |
| 5,839,020 | 11/1998 | Rushing et al. | 399/49 |

FOREIGN PATENT DOCUMENTS 08-106217 4/1996 Japan .

OTHER PUBLICATIONS

U.S. application No. 08/580,263, Ng et al., filed Dec. 28, 1995.

U.S. application No. 08/581,025, Donahue et al., filed Dec. 28, 1995.

U.S. application No. 08/799,673, Rushing et al., filed Feb. 11, 1997.

U.S. application No. 08/841,008, Ziegelmuller et al., filed Apr. 29, 1997.

U.S. application No. 08/845,300, Vreeland et al., filed Apr. 25, 1997.

*Primary Examiner*—Arthur T. Grimley
*Assistant Examiner*—Sophia S. Chen
*Attorney, Agent, or Firm*—Norman Rushefsky

[57] ABSTRACT

An electrostatographic recording apparatus and method wherein a primary charger establishes a uniform electrostatic charge on an electrophotoconductive image recording member in accordance with a first operating parameter. A recording device imagewise modulates the charge on the image recording member to form electrostatic latent images in accordance with a second operating parameter and also forms a developable process control patch. A development station develops the electrostatic latent images and the control patch on the image recording member with toner in accordance with a third operating parameter. A replenishment device provides toner to the development station at a controlled rate in accordance with a replenishment signal. A sensor senses density of the control patch developed by the development station; and a controller is responsive to density of the control patch and provides adjustments to the first, second and third operating parameters and controls a reference signal used to generate the replenishment signal as a function of a parameter related to one of the first, second or third operating parameters. Preferably the controller controls the reference signal as a function of the parameter related to the first operating parameter, primary voltage setpoint.

11 Claims, 15 Drawing Sheets

METHOD AND APPARATUS FOR CONTROL OF VARIABILITY IN CHARGE TO MASS RATIO IN A DEVELOPMENT STATION

CROSS-REFERENCE TO RELATED APPLICATIONS

This application is related to commonly assigned U.S. application Ser. No. 08/999,451 filed in the names of Matthias Regelsberger et al and entitled Process Control For Electrophotographic Recording; U.S. application Ser. No. 08/998,789 filed in the names of Matthias Regelsberger et al and entitled Image Forming Apparatus and Method with Control of Electrostatic Transfer Using Constant Current, and U.S. application Ser. No. 08/999,113, now U.S. Pat. No. 5,862,433, filed in the names of Matthias Regelsberger et al. and entitled Electrostatographic Method and Apparatus With Improved Auto Cycle-Up, all filed on even date herewith.

BACKGROUND OF THE INVENTION

1. Field of the Invention

This invention relates to the field of electrostatography, and more particularly, to improvements in a method and apparatus for controlling toner replenishment.

2. Description of the Prior Art

Toning or development stations for electrophotographic (EP)copiers and printers typically have two-component developer mixtures (carrier and toner). Toner depleted by toning latent images on the photoconductor must be replaced by replenishing with new toner, so that the toner concentration (TC) remains within a usable range in the toning station developer mix.

Closed-loop toner concentration control, for example see U.S. Pat. No. 4,875,078, is typically achieved by means of a TC monitor and control logic to drive a toner replenishment mechanism. TC monitors are of several types, including optical and magnetic. As noted in U.S. Pat. No. 5,649,266, one common practice is to adjust the monitor output, $V_{MON}$, to 2.500V when a new load of developer at nominal 10% concentration is installed in the development station. The replenishment algorithm then acts to regulate $V_{MON}$ to this initial 2.500V value. Maintaining $V_{MON}$=2.500V assures that TC=10% (barring monitor drift) regardless of TC monitor sensitivity.

The regulation of a replenishment control signal is made by comparing the toner monitor output $V_{MON}$ with a set voltage reference $T_{ref}$ and control toner replenishment based on the difference between $T_{ref}$ and $V_{MON}$. In order to regulate TC to 10%, $T_{ref}$ has been fixed at 2.500 volts. As may be seen with reference to FIGS. 7 and 8, a toner concentration monitor voltage $V_{MON}$ greater than $T_{ref}$ indicates a toner concentration lower than aim, typically 10% as noted above, and results in the toner replenishment adding toner to the toning station.

For a given developer as toner concentration increases the toner charge to mass ratio (Q/m) decreases, and vice versa. Best system performance is observed when the toner Q/m is within a particular range. An example of a range for one application may be, for example, in the range of 17–23 $\mu$C/g. Problems arise when the ratio of Q/m migrates above or below the particular range suited for the particular application. Examples of problems when the Q/m ratio is high are the tendency for transfer mottle or breakdown. Examples of problems when the Q/m ratio is low is the tendency towards excessive dusting and hollow character formation. Low values of Q/m can occur even though the developer is not considered old and need not be replaced. An additional problem faced with developers that have high variability in the Q/m ratio is that compensation needs to be made in other process parameters to obtain desirable image density. These compensations such as in primary charge level $V_o$ require commensurate broadening of the operating parameters of the system requiring more expensive components and greater difficulties in maintaining control. An additional problem is created in that measuring directly the ratio of Q/m requires additional controls and/or sensors.

SUMMARY OF THE INVENTION

It is therefore an object of the invention to provide for control in variability of the Q/m ratio in a development station by limiting swings of Q/m ratio to a preferred operating range. A further object is to control dusting at low Q/m ratios of toners in development stations. A further object of the invention is to provide inference of the Q/m ratio by a change in an EP process control setpoint. Still another object of the invention is to provide for changes in a toner concentration reference signal according to the Q/m ratio inferred by the EP process setpoints.

In accordance with one aspect of the invention, there is provided an electrostatographic recording apparatus comprising an image recording member; a primary charger that establishes a uniform electrostatic charge on the image recording member in accordance with a first operating parameter; a recording device or devices that imagewise modulates the charge on the image recording member to form electrostatic latent images in accordance with a second operating parameter and to form a developable process control patch; a development station that develops the electrostatic latent images and the control patch on the image recording member with toner in accordance with a third operating parameter; a replenishment device for providing toner to the development station at a controlled rate in accordance with a replenishment signal; a sensor that senses density of the control patch developed by the development station; and a controller responsive to density of the control patch and providing adjustments to the first, second and third operating parameters and controlling a reference signal used to generate the replenishment signal as a function of a parameter related to one of the first, second or third operating parameters.

In accordance with a second aspect of the invention, there is provided an electrostatographic recording method comprising establishing a uniform electrostatic charge on an image recording member in accordance with a first operating parameter; imagewise modulating the charge on the image recording member to form electrostatic latent images in accordance with a second operating parameter and forming a developable process control patch; operating a development station to develop the electrostatic latent images and the control patch on the image recording member with toner in accordance with a third operating parameter; providing toner to the development station at a controlled rate in accordance with a replenishment signal; sensing density of the control patch developed by the development station; and in response to density of the control patch providing adjustments to the first, second and third operating parameters and controlling a reference signal used to generate the replenishment signal as a function of a parameter related to one of the first, second or third operating parameters.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention is described below in the environment of a particular electrophotographic copier and/or printer. However, it will be noted that although this invention is suitable for use with such machines, it also can be used with other types of electrophotographic copiers and printers.

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_O$=Primary voltage (relative to ground) on the photoconductor as measured just after the primary charger. This is sometimes referred to as the "initial" voltage.

$E_O$=Light produced by the printhead to form a discharged area on the photoconductor needed to produce a density $D_{MAX}$ or a control parameter such as current to the printhead to generate a density $D_{MAX}$.

Figure 1:
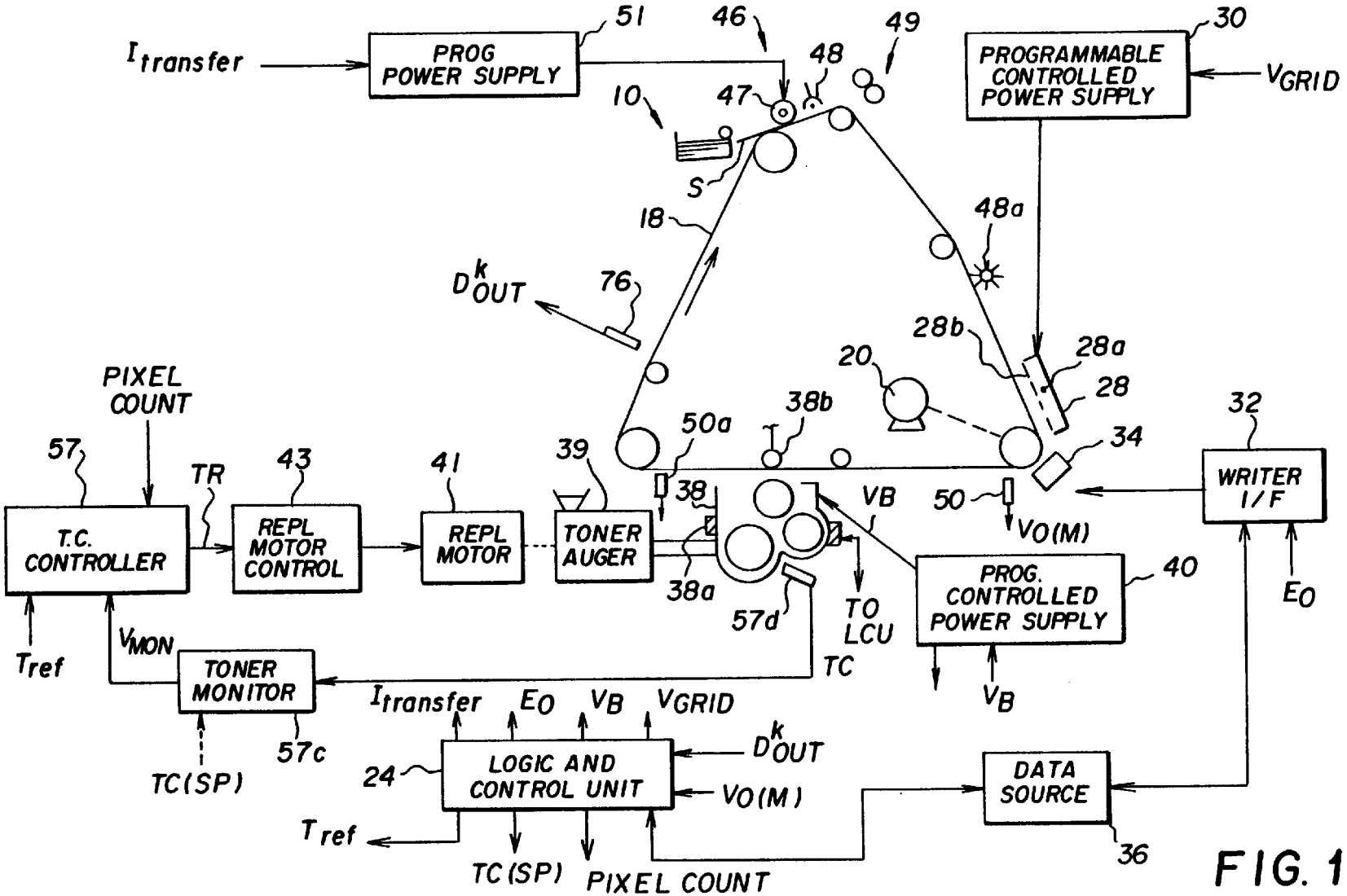
FIG. 1 is a schematic showing a side elevational view of an electrostatographic recording apparatus of the present invention.

With reference to the machine 10 as shown in FIG. 1, a moving image recording member such as photoconductive belt 18 is driven by a motor 20 past a series of work stations of the printer. The recording member may also be in the form of a drum. A logic and control unit (LCU) 24, which has a digital computer, has a stored program for sequentially actuating the various work stations.

Briefly, a charging station sensitizes belt 18 by applying a uniform electrostatic charge of predetermined primary voltage $V_O$ to the surface of the belt. The output of the charger 28 at the charging station is regulated by a programmable controller 30, which is in turn controlled by LCU 24 to adjust primary voltage $V_O$ for example through control of electrical potential ($V_{GRID}$) to a grid that controls movement of charged particles, created by operation of the charging wires, to the surface of the recording member as is well known.

At an exposure station, projected light from a write head 34 modulates the electrostatic charge on the photoconductive belt to form a latent electrostatic image of a document to be copied or printed. The write head preferably has an array of light-emitting diodes (LEDs) or other light source such as a laser or other exposure source for exposing the photoconductive belt picture element (pixel) by picture element with an intensity regulated in accordance with signals from the LCU to a writer interface 32 that includes a programmable controller. Alternatively, the exposure may be by optical projection of an image of a document or a patch onto the photoconductor. It is preferred that the same source that creates the patch used for process control to be described below also exposes the image information.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 32 for identifying exposure correction parameters in a look-up table (LUT) for use in controlling image density. In order to form patches with density, the LCU may be provided with ROM memory or other memory representing data for creation of a patch that may be input into the data source 36. Travel of belt 18 brings the areas bearing the latent electrostatographic charge images past a development station 38. The toning or development station has one (more if color) magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern which includes development of the patches used for process control.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46, as is also well known, is provided for moving a receiver sheet S into engagement with the photoconductor in register with the image for transferring the image to a receiver sheet such as plain paper. Alternatively, an intermediate member may have the image transferred to it and the image may then be transferred to the receiver sheet. In the embodiment of FIG. 1, the transfer station includes a transfer roller 47 having one or more semiconductive layers that typically are supported on a conductive core. The resistivity of the semiconductive layer or layers may be from about $10^5$ ohm-cm to about $10^{12}$ ohm-cm and more preferably from about $0.5\times10^9$ to about $5.0\times10^9$ ohm-cm. An example of a transfer roller is disclosed in U.S. application Ser. No. 08/845,300 filed in the name of Vreeland et al, the contents of which are incorporated herein by reference. Alternatively, the core may be made insulative and electrical bias applied to the semiconductive layer(s). As an alternative to a transfer roller, a transfer belt may be used. A semiconductive layer on the roller engages the receiver sheet in a nip formed between the transfer roller and the toner image bearing surface of the belt 18. Electrostatic transfer of the toner image is effected with a proper voltage bias applied to the transfer roller 46 so as to generate a constant current as will be described below. After transfer the receiver sheet is detacked from the belt 8 using a detack corona charger 48 as is well known. A cleaning station 48*a* is also provided subsequent to the transfer station for removing toner from the belt 18 to allow reuse of the surface for forming additional images. In lieu of a belt a drum photoconductor or other structure for supporting an image may be used. After transfer of the unfixed toner images to a receiver sheet, such sheet is transported to a fuser station 49 where the image is fixed.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices. In order to precisely control timing of various operating stations, it is well known to use encoders in conjunction with indicia on the photoconductor to timely provide signals indicative of image frame areas and their position relative to various stations. Other types of control for timing of operations may also be used.

Process control strategies generally utilize various sensors to provide real-time control of the electrostatographic process and to provide "constant" image quality output from the user's perspective.

One such sensor may be a densitometer 76 to monitor development of test patches preferably in non-image areas of photoconductive belt 18, as is well known in the art. However, the invention may be used where density is recorded with an image frame. The densitometer may include an infrared LED which shines light through the belt or is reflected by the belt onto a photodiode or other light detector. Typically, where the belt is substantially or generally transparent to the light density is determined using transmission and where the belt is substantially or generally non-transparent to the light density is determined using reflection. In the preferred embodiment, the patch density is periodically changed so that it is sometimes at the high density ($D_{MAX}$) end of the tone scale and at other times it is at intermediate tone scales. The densitometer is preferably of the transmission type and wherein the photoconductor is relatively transparent to the infrared light or other light used for detecting density of the patch. A densitometer signal with high signal-to-noise ratio is obtained in the preferred embodiment, but a lower nominal density level and/or a reflection densitometer would be reasonable alternatives in other configurations. The photodiode generates a voltage proportional to the amount of light received. This voltage is compared to the voltage generated due to transmittance or reflectance of a bare patch, to give a signal representative of an estimate of toned density. This signal $D^k_{OUT}$ may be used to adjust $V_O$,$E_O$, or $V_B$ and to assist in the maintenance of the proper concentration of toner particles in the developer mixture and the adjustment of transfer current $I_{TR}$. The reference indicium k refers to the contone level or target density of the patch which the printhead was provided with data to generate. Thus, for printing a $D_{MAX}$ patch, grey level data for exposing pixels at level 15 is provided in a 4 bits/pixel system. The use of 4 bits/pixel is used as an example and can define pixels of grey levels from 0–15 wherein 0 in this case is least dense and 15 is most dense. Periodically, exposures at intermediate grey levels 5 and 10 will also be made to generate patches of density lower than $D_{MAX}$.

In the preferred embodiment, a schedule for generating patches is provided for controlling the grey levels of patches as well as their frequency of occurrence and individual repetition. The resulting density signal is used to detect changes in density of a measured patch to control primary voltage $V_O$, exposure $E_O$, bias voltage $V_B$ and/or transfer current as will be described below. To do this, in general, $D^k_{OUT}$ is compared with a signal $D^k_{SP}$ representing a setpoint density value for a patch of contone level k and differences between $D^k_{OUT}$ and $D^k_{SP}$ cause the LCU to change settings of $V_{GRID}$ on primary charging station 28 and adjust exposure $E_O$ through modifying exposure duration or light intensity for recording a pixel. Adjustment to the potential $V_B$ at the development station is also provided for.

In a two-component developer provided in development or toning station 38, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration (TC) that is less than that of a setpoint value. For example, a toner monitor probe 57*d* is a transducer that is located or mounted within or proximate the development station and provides a signal TC related to toner concentration. This signal is input to a toner monitor which in a conventional toner monitor causes a voltage signal $V_{MON}$ to be generated in accordance with a predetermined relationship between $V_{MON}$ and TC (see FIGS. 6A and 8). The voltage $V_{MON}$ is then compared with a reference voltage, $T_{ref}$, of say 2.5 volts which would be expected for a desired toner concentration of say 10%. Differences of $V_{MON}$ from this reference voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices (see FIGS. 6B and 7). With such monitors, a particular parametric relationship between TC and $V_{MON}$ may be selected in accordance with a voltage input representing a toner concentration setpoint signal value, TC(SP). Thus changes in TC(SP) can affect the rate of replenishment by affecting how the system responds to changes in toner concentration that is sensed by the toner monitor.

Process Control

The invention described herein is directed to compensating for changes induced by environmental changes and rest/run effects by control of $V_O$, $E_O$, and $V_B$ and is sufficiently robust as to provide for control of toner concentration in accordance with the invention herein.

In the preferred embodiment, the patch frequency in the patch schedule is changed according to predetermined environmental changes; e.g. the patch frequency is typically at 1 patch/100 frames in the print production mode, whereas the patch frequency is set to 1 patch/14 frames during the startup mode.

Figures 1, 2A:
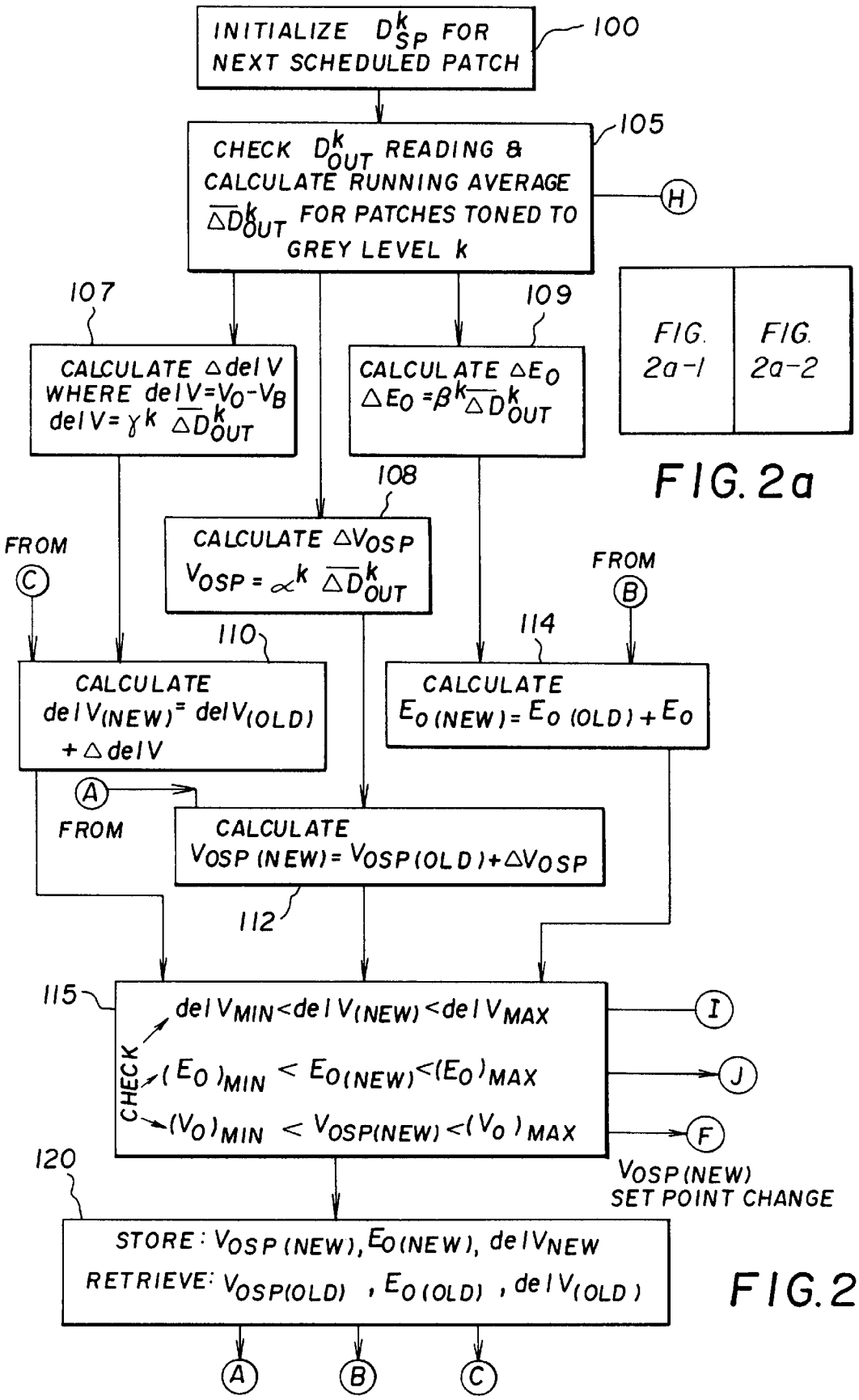
FIGS. 2*a* and 2*b* is a flowchart of a program operative for determining new values of $V_O$,$E_O$ and $V_B$ in operation of the apparatus of FIG. 1.
Figures 2, 2A:
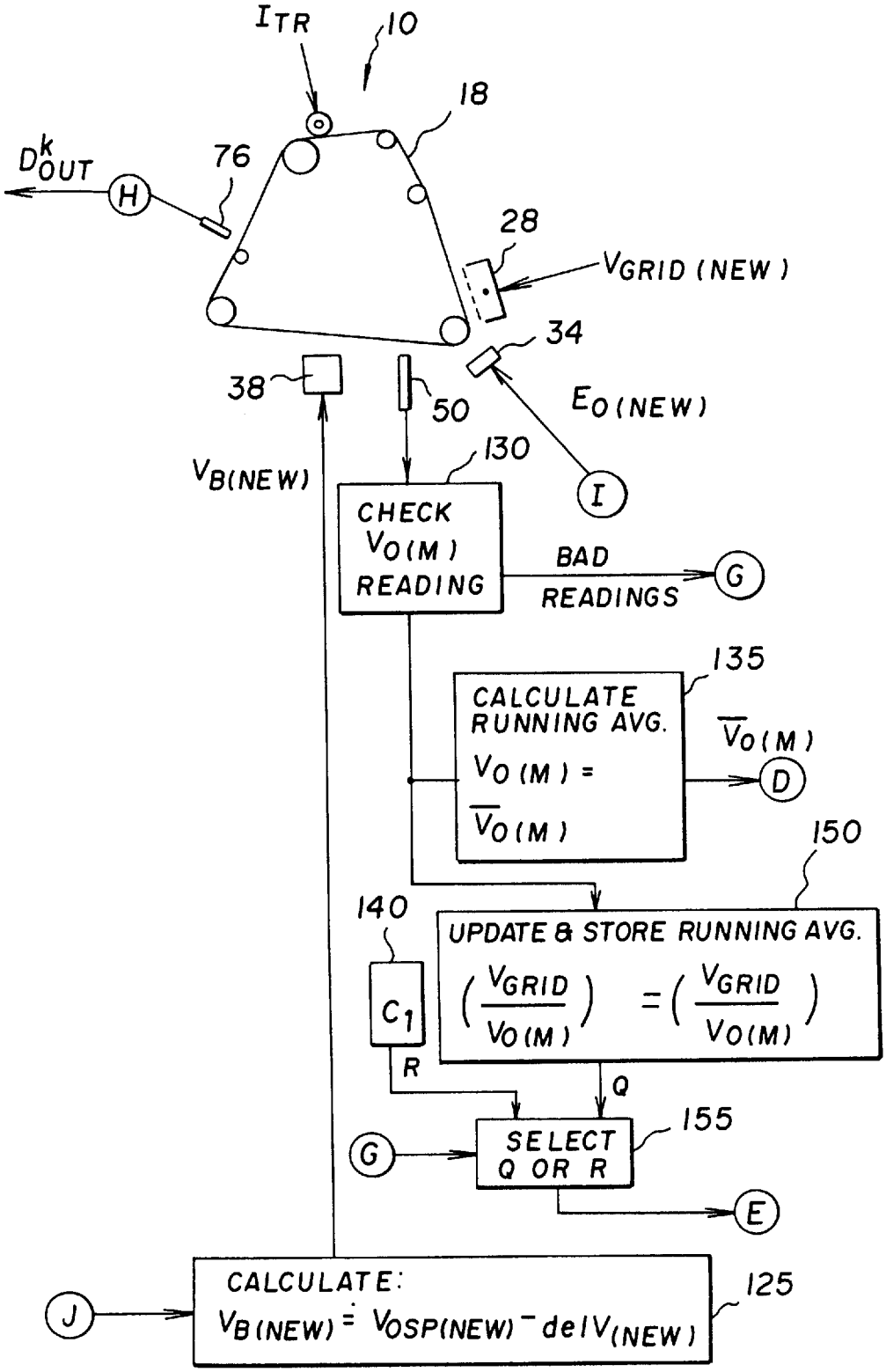
Figure 2B:
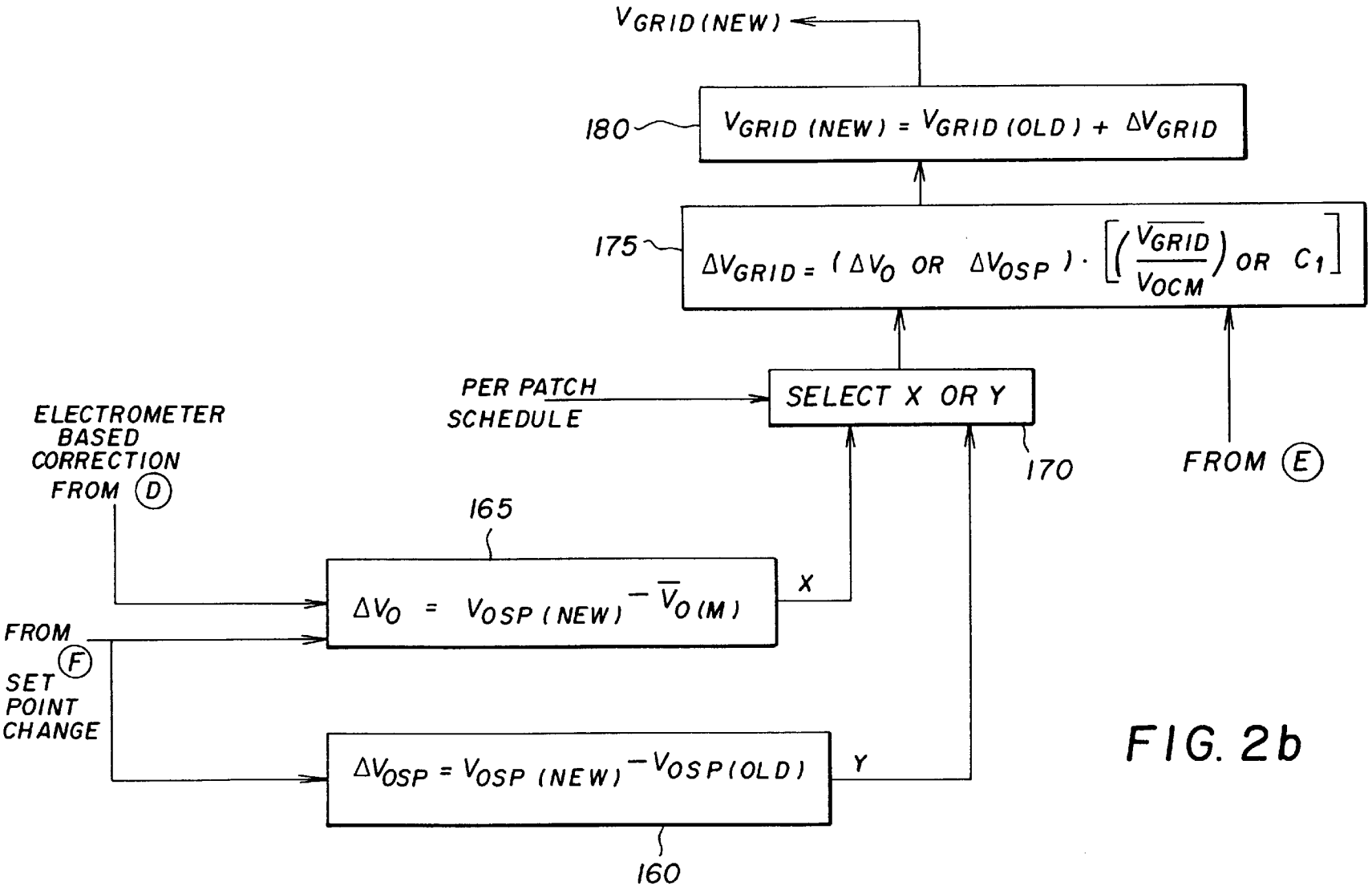

With reference now to FIGS. 2*a* and 2*b,* there is shown a flowchart for programming a controller for controlling parameters $V_O$ generated by the primary corona charger 28, $E_O$ generated by the LED printhead 34 of FIG. 1 and $V_B$ the bias to the development station 38. As is well known, control of $V_O$ is advantageously provided for by adjustment of the potential to a grid 28*b* in those primary chargers which employ such a grid. With such chargers, corona or charged ions generated by the corona wire 28*a,* which are at an elevated potential level, are caused to pass through the grid to an insulating layer on the photoconductor, which photoconductor is otherwise grounded. The charge level builds on this insulating layer to a level proximate that of the potential on the grid. Thus $V_{GRID}$, the potential on the grid, provides a reasonably close correspondence to the primary charge $V_O$ created on the photoconductor. Other primary chargers that do not employ a grid may also be used. Control of $E_O$ is preferably made by control of current to an electronic exposure source such as LED printhead 34. Examples of LED printheads are described in U.S. Pat. Nos. 5,253,934; 5,257,039 and 5,300,960 and U.S. application Ser. Nos. 08/581,025, filed Dec. 28, 1995 in the names of Michael J. Donahue et al and entitled "LED Printhead and Driver Chip For Use Therewith Having Boundary Scan Test Architecture" and 08/580,263, filed Dec. 28, 1995 in the names of Yee S. Ng et al and entitled "Apparatus and Method for Grey Level Printing with Improved Correction of Exposure Parameters." In the references just described, there are illustrated examples of LED printheads which are formed of plural chip arrays arranged in a single row. Typically, 64, 96, 128 or 196 LEDs are arranged on a chip array in a row and when the chip arrays are in turn arranged on a printhead support, a row of several thousand LEDs is provided that is made to extend across, and preferably perpendicular, to the direction of movement of the photoconductor. Desirably, the number of LEDs (typically five to six thousand) are such so as to extend for the full width or available recording width of the photoconductor so that the LED printhead may be made stationary. The LEDs are typically fabricated to be pitched at 1/300th or better yet 1/600th to the inch in the cross-track dimension of the photoconductor. Control of current and selective enablement is provided by driver chips that are also mounted on the printhead. Typically, one or two driver chips are associated with each LED chip array to provide a controlled amount of current to an LED selected to record a particular pixel at a particular location on an image frame of the photoconductor. Since LED printing is conventional, further details are either well known or may be obtained from the aforementioned references. In control of current to each LED for recording a pixel, the above patent literature notes that two parameters may be used. One of the parameters referred to in this literature has to do with a global adjustment parameter or capability for the LED printhead. With a global adjustment capability, which we may call "$G_{REF}$" (also known in the patent literature as $V_{REF}$), there is provided the ability to change by a certain amount current generated by the driver chips for driving LEDs selected to be enabled. The LED printheads disclosed in the above patent literature may also have a local adjustment capability ($L_{REF}$) that may be used to adjust current generated by some driver chips differently than current generated by others. The reasons for providing both global and local current adjustment capability is that LED driver chips and LEDs on certain chips may vary from batch to batch due to process differences during manufacture. When the LED printhead is manufactured, these process differences may be accommodated by allowing selection of different currents generated by different driver chips on the same printhead. In addition, if a printhead while in use has temperature differentials on the printhead, provision may be made for controlling current to a different extent for each driver chip. However, due to aging of the printhead and/or changes in electrophotographic process conditions, global changes to driver current are advantageously provided for in order to change the parameter $E_O$. In a system which employs discharge area development, exposure of a pixel area by an LED will cause that pixel area to be developed. The more the exposure, the greater the density until an exposure is provided that provides a maximum development capability. Thus, for example, to create a patch of density $D_{MAX}$, a block of many LEDs similarly illuminated each to a necessary or required exposure value to create an exposed patch area on the photoconductive belt 18 of density $D_{MAX}$.

With reference still now to the flowchart illustrated in FIGS. 2*a* and 2*b,* the apparatus of FIG. 1 under control of the programmed logic and control unit 24 causes a calibration mode to be entered every few image frames; for example, every 100 image frames during a normal production run, more frequently, say every 14 image frames during start-up. In this mode, parameters used for recording a next set of patches each of a preprogrammed density k wherein k=5, 10, or 15 wherein $D_{MAX}$ is tone scale level 15 are stored in memory. The set of patches may be in an interframe area on the photoconductor and several may be recorded throughout the width of the photoconductor to ensure similar operation of selected groups of LEDs. In any interframe each patch, if more than one, will have the same tone scale level. After a patch or set of patches is recorded, an interframe area $V_O$ on the photoconductor in a non-exposed area of this interframe is measured by electrometer 50. For an electrometer mounted between the primary charger and the printhead, the measurement of $V_o$ can be taken prior to exposure anywhere on the film. Depending on the size of the electrophotographic process, the response time of the electrometer itself and service needs, the specific position of the electrometer may be suitably selected. The measured value of $V_O$ will be referred to as $V_{O(M)}$ wherein "M" implies measured. After the patch is toned at development station 38, the density of the patch $D_{OUT}$ is measured by densitometer 76.

In recording the patch of tone level k there is associated with this patch a setpoint density $D_{SP}^k$ representing an expected reading value which is determined experimentally and stored in LCU 24. When a patch of one of the tone levels k is recorded, the associated value $D_{SP}^k$ is recalled, step 100 of FIG. 2*a*. With the reading of density, $D_{OUT}^k$, of the patch, a calculation is made of $\Delta D_{OUT}^k = D_{OUT}^k - D_{SP}^k$. The new value of $\Delta D_{OUT}^k$ is then used to generate an updated running average of $\Delta D_{OUT}^k$ which is indicated as $\overline{\Delta D}_{OUT}^k$. A running average to reduce signal to noise ratio may be taken in accordance with the following equation:

$$\overline{\Delta D}^k_{OUT} = \frac{1}{n}\Delta D^k_{OUT} - \left(1 - \frac{1}{n}\right)\left[(\overline{\Delta D}^k_{OUT})_{OLD}\right] \quad (1)$$

In equation (1) the present reading of density is multiplied by a suitable weighting factor such as, for example, ⅓, while the previous calculated running average $\overline{\Delta D}_{OUT}{}^k$ is multiplied by a weighting average of $$\left(1 - \frac{1}{n}\right),$$

in this example ⅔. The updated value of $\overline{\Delta D}_{OUT}{}^k$ is determined using readings only of patches toned to the particular level k, step 105. The running average according to Equ.(1) implies careful consideration for initializing the very first reading, e.g. at power-up. In the preferred embodiment, the filter value is initialized at power-up with the last setpoint in memory and after each patch with the new setpoint.

After calculation of $\overline{\Delta D}_{OUT}{}^k$, the updated running average change in measured density from setpoint density, various parameters are calculated. In step 107 the parameter ΔdelV is calculated. The parameter delV is the difference between the primary voltage $V_O$ and the bias $V_B$ on the toning station and represents bias offset. A parameter relating to a needed change in bias offset, ΔdelV, is determined by:

$$\Delta \mathrm{del}V = \gamma^k \overline{\Delta D}_{OUT}{}^k \quad (2)$$

In step 108 a change in setpoint for $V_O$,$\Delta V_{OSP}$, is calculated in accordance with the following formula:

$$\Delta V_{OSP} = \alpha^k\, \overline{\Delta D}_{OUT}{}^k \quad (3)$$

In step 109 a change in needed exposure, $\Delta E_O$, is calculated in accordance with the following formula:

$$\Delta E_O = \beta^k\, \Delta D_{OUT}{}^k \quad (4)$$

In equations (2), (3) and (4) the terms $\alpha^k$, $\beta^k$ and $\gamma^k$ are respective particular constants or coefficients associated with a particular contone level k. In general, the values of these constants change with contone level k; however, the ratio of $\alpha^k$,$\beta^k$ and $\gamma^k$ does not change with contone level k. For example, for patches of level k=15 ($D_{MAX}$), the coefficients by which the entire tonescale is stabilized are 40/10/2. For patches of contone levels less than $D_{MAX}$, the densitometer readings are smaller yet a similar in magnitude correction to the setpoints are needed to stabilize the tonescale. For the densitometer used in the preferred embodiment, the densitometer reading for contone level k=10 is ½ of that for contone level k=15. Therefore, the coefficients for k=10 are 80/20/4. Similarly, for k=5, the densitometer reading is ¼ of that for k=15 and the coefficients are 160/40/8.

Although this approach provides very satisfying results at rather frequent patch intervals, the patches can cause backside markings of the receiver paper because the patch may not be cleaned off completely in one revolution of the transfer system. Thus, creation of a patch may require a skip frame. Assuming the electrophotographic process is sufficiently stable with no observable shift in the tonescale during a production run mode over run lengths of about 200 prints, the frequency of creating a patch may be reduced. Therefore, the preferred embodiment uses a patch frequency of 1 patch/100 frames or less. With less frequent patches, e.g., 1 patch/100 frames, the above approach to process control is modified to deliver the desired tonescale stability. Since only one patch is generated every 100 frames, patches of the same contone level occur at every p×100 frames with p being the number of different contone levels in the patch schedule. With three contone levels e.g. k=15, 10 and 5 in the patch schedule, the coefficients were modified to be 40/20/0 for k=15, 0/0/4 for k=10 and 0/0/8 for k=5. In this case the patch of level k=15 ($D_{MAX}$) serves as a coarse adjustment every 300 frames with intermediate fine adjustments using contone levels k=10 and k=5 every 100 frames in between. The coefficients for k=10 and k=5 only affect the bias offset delV and thus only the mid and low density range of the tonescale. In this regard, reference may be had to pending U.S. application Ser. No. 08/799,673, filed Feb. 11, 1997 in the names of Allen J. Rushing et al.

In steps 110, 112 and 114, updated new values for delV, $E_O$ and $V_{OSP}$($V_O$ setpoint) are calculated:

$$\mathrm{del}V_{(NEW)} = \mathrm{del}V_{(OLD)} + \Delta \mathrm{del}V \quad (5)$$

$$E_{O(NEW)} = E_{O(OLD)} + \Delta E_O \quad (6)$$

$$V_{OSP(NEW)} = V_{OSP(OLD)} + \Delta V_{OSP} \quad (7)$$

In calculating $\mathrm{del}V_{(NEW)}$, $E_{O(NEW)}$ and $V_{OSP(NEW)}$, prior values corresponding to these values, i.e. $\mathrm{del}V_{(OLD)}$, $E_{O(OLD)}$ and $V_{OSP(OLD)}$ are retrieved from memory.

In step 115 the newly calculated values for $\mathrm{del}V_{(NEW)}$, $E_{O(NEW)}$ and $V_{OSP(NEW)}$ are checked against respective predefined minimum and maximum values and if within the predefined range for correct operation are stored for use in the next calculation of these respective values, step 120, and also for use in generating the upcoming parameters of operation of the EP process as will now be described.

In step 125 the toning station bias VB(NEW) is calculated by:

$$V_{B(NEW)} = V_{OSP(NEW)} - \mathrm{del}V_{(NEW)} \quad (8)$$

The calculated value of $V_{B(NEW)}$ is stored and then applied to the toning station 38 when the interframe immediately preceding the image frame that has received a primary charge using the new calculated value for $V_{OSP(NEW)}$ enters the development zone.

In order to calculate the new grid voltage setting for the primary charger, the value $V_{OSP(NEW)}$ is used in step 160 to calculate a needed setpoint change in primary voltage, $\Delta V_{OSP}$, in accordance with the equation:

$$\Delta V_{OSP} = V_{OSP(NEW)} - V_{OSP(OLD)} \quad (9)$$

While corrections to the setpoint for the primary voltage according to Equ. 9 are evaluated with every density patch at rather low frequency; e.g., once every 100 frames, an electrometer reading of the actual film voltage is made every frame. The electrometer reading is made in a location of the interframe where no exposure has been made. The electrometer is located immediately downstream of the printhead 34 or may be located between the primary charger and the printhead. The measured value of $V_O$ denoted $V_{O(M)}$ is checked in step 130 to ensure a proper reading is obtained and if this is a proper reading the value is used in calculating an updated running average value for $V_{O(M)}$ denoted as $\overline{V}_{O(M)}$, step 135. The running average may be calculated using a weighted averaging for $V_{O(M)}$ (similar to the weighted averaging calculated in Equ. (1)). This running average is used in step 165 to calculate a difference, $\Delta V_O$, between the current setpoint for $V_{OSP}$ and the updated running average of actual measurement of $V_{O(M)}$ in accordance with the following equation.

$$\Delta V_O = V_{OSP(NEW)} - \bar{V}_{O(M)} \tag{10}$$

In step 150, the electrometer's reading of primary voltage $V_{O(M)}$ is also used to calculate an inverse of an efficiency related value to primary charger operation. This inverse of the efficiency related value is the ratio of the primary charger's grid voltage, $V_{GRID}$, to the measured primary voltage as read by the electrometer $V_{O(M)}$ for the interframe whose primary charge was established using the $V_{GRID}$ setting. Primary charger efficiency is related to the mechanical placement variables of the charger relative to the photoconductor, e.g. spacing, and to relative humidity in the area of the charger. Additional factors include photoreceptor type and age. It is preferred to use for calculation of a new grid voltage a running average of the inverse of the charger efficiency. Thus, the current; i.e. present, ratio of inverse efficiency is used to calculate an updated running average of inverse efficiency denoted $$\overline{\left(\frac{V_{GRID}}{V_{O(M)}}\right)}$$

in step 150. This running average may be calculated using a weighted averaging for the ratio $$\overline{\left(\frac{V_{GRID}}{V_{O(M)}}\right)}$$

analogous to the weighted average calculated in Equ. (1). This value is described as an inverse of efficiency since grid voltage will be a higher absolute value than the primary voltage level laid down by the primary charger and thus the ratio is typically higher than 1, however, it will hereafter be referred to as a parameter related to charger efficiency. In the event that in step 130 the current value of $V_{O(M)}$ is determined to be inaccurate, e.g., such that malfunction of the electrometer has to be assumed, this value for $V_{O(M)}$ is discarded. After repeatedly incorrect readings of $V_{O(M)}$ a signal indicating a bad value is used in step 155 to select a constant $C_1$ (step 140) that is stored and represents a long term determined value for charger efficiency. $C_1$ is calculated using average values of efficiency over long periods of operation under different humidity conditions. While $C_1$ and $$\overline{\left(\frac{V_{GRID}}{V_{O(M)}}\right)}$$

both represent an average, the latter includes weighting factors that give relatively substantial weight to the current reading. Note that in calculating running averages for the various parameters described herein, the weightings may be different for the different parameters. That is, the value $$\frac{1}{n}$$

was described as ⅓ for calculating $\overline{\Delta D}_{OUT}{}^{k}$ but $$\frac{1}{n}$$

may be different when calculating $\overline{V}_{O(M)}$ and $$\overline{\left(\frac{V_{GRID}}{V_{O(M)}}\right)}.$$

In the above, equations (9) and (10), both yield corrections to the primary voltage. Corrections to the primary voltage according equation (9) result from a density patch and are corrections to the setpoint. Corrections to the primary voltage according to equation (10) result from electrometer readings constantly comparing the actual film voltage with the desired setpoint voltage. Since patches are generated according to a preprogrammed patch schedule, e.g., 1 patch/100 frames, corrections to the primary voltage according to equation (9) become available every 100 frames. For all other times, corrections to the primary voltage according to equation (10) are made. It should be noted that corrections according to equation (9) step 160 in FIG. 2) are solely derived from densitometer readings and are independent of electrometer readings.

In step 175, the value of patches may be $\Delta V_{OSP}$ or $\Delta V_O$ according to equation (9) or (10) as per patch schedule (step 170) and the primary charger efficiency parameter as selected in step 155 are used to calculate a determined change in grid voltage $\Delta V_{GRID}$ according to the following equation:

$$\Delta V_{GRID} = (\Delta V_O \text{ or } \Delta V_{OSP}) \cdot \left[\overline{\left(\frac{V_{GRID}}{V_{O(M)}}\right)} \text{ or } C_1\right] \tag{11}$$

In equation 11, the term for charger efficiency is replaced by constant $C_1$ if the electrometer reading is determined to be bad. If a patch is scheduled, then $\Delta V_{OSP}$ is selected.

In step 180, the new grid voltage is calculated by adding the calculated change to grid voltage to the present setting for grid voltage or by the equation:

$$V_{GRID(NEW)} = V_{GRID(OLD)} + V_{GRID} \tag{12}$$

The grid voltage is then changed accordingly by a signal from the LCU 24 to a programmable controller forming a part of the primary charger's power supply 30. The grid voltage is then adjusted accordingly.

With adjustment of grid voltage and thus a change in primary film voltage $V_O$ there is an adjustment also made to exposure using the new value of $E_O$ calculated. As noted above, this value may be a new current value that is used to enable the recording elements when recording image frames that have a primary voltage that was adjusted to $V_{O(NEW)}$.

Figure 3A:
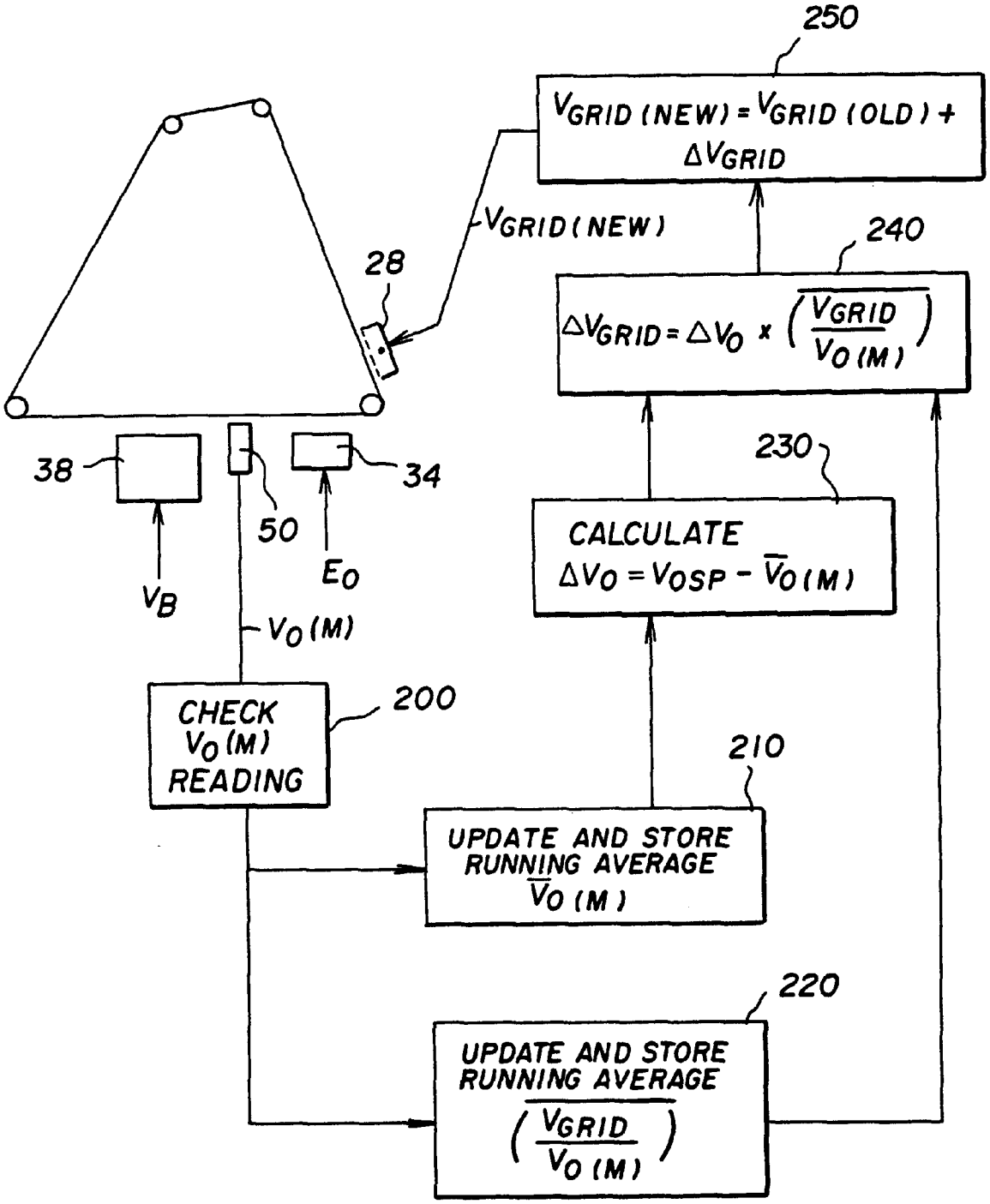
FIGS. 3*a* and 3*b* are a flowchart diagram illustrating a control process used in accordance with the invention for control of $V_O$ in the electrostatographic recording apparatus of FIG. 1 during intervals between patch creation modes.

As noted above, in the process of FIGS. 2*a* and 2*b*, an interframe patch is preferably created only once in say 100 image frames during a production operation of the copier/printer. In order to provide some interim process control between patch creation modes the process control method illustrated in FIGS. 3 and 3*b* may be used. With reference to the flowchart of FIGS. 3*a* and 3*b* for each interframe a reading or sensing of primary voltage is made to generate a signal $V_{O(M)}$. This read signal is checked in step 200 to determine if it is within a range deemed to provide a valid reading. If it is a valid reading, $V_{O(M)}$ is used to generate an updated running average of the measurements $V_{O(M)}$ since the last $V_{GRID}$ adjustment. This running average is denoted $V_{O(M)}$ step 210. An updated running average for the parameter related to charger efficiency $$\overline{\left(\frac{V_{GRID}}{V_{O(M)}}\right)}$$

is also generated, step 220. A determined change in primary voltage $\Delta V_O$ is calculated in step 230 by using the last value for $V_O$ setpoint calculated after the densitometer reading of the last read patch and according to the following equation:

$$\Delta V_O = V_{OSP} - \bar{V}_{O(M)} \tag{13}$$

The calculated value $\Delta V_O$ for change in primary voltage is then used to calculate in step 240 a change in grid voltage $\Delta V_{GRID}$ in accordance with the equation:

$$\Delta V_{GRID} = \Delta V_O \times \overline{\left(\frac{V_{GRID}}{V_{O(M)}}\right)} \tag{14}$$

In step 250 the new value of grid voltage is calculated in accordance with the equation:

$$V_{GRID(NEW)} = V_{GRID(OLD)} + \Delta V_{GRID} \tag{15}$$

In equation 15, the term $V_{GRID(OLD)}$ represents the value of the grid voltage used to generate the primary voltage that was last read by the electrometer. After calculation of $V_{GRID(NEW)}$ the programmable control for the primary charger causes adjustment of the grid voltage commencing with the next available interframe. To ensure that the primary charge level is sufficiently stable, the adjustment is compared to a maximum allowed adjustment. If necessary, larger than maximum allowed adjustments will be applied in successive small steps.

In accordance with the invention described in referenced U.S. application Ser. No. 08/799,673, filed Feb. 11, 1997 and entitled "Method and Apparatus for Controlling Production of Full Productivity Accent Color Image Formation" in the names of Allen J. Rushing et al and as also used herein, EP process control is accomplished by means of a densitometer measuring the density of toned patches in the interframe. A programmed microprocessor or other control device compares the actual voltage reading of the densitometer with an aim voltage for that toned level used as interframe patch and adjusts the setpoints for $V_O$ (primary voltage) and $E_O$ (exposure). Using a constant ratio in the adjustments of these two setpoints, the entire tone scale (all contone levels) are kept at the desired density levels although only interframe patches of a very few contone levels, e.g., 5, 10, 15 are used to monitor the EP process.

An electrometer is used as a secondary sensor to improve the accuracy of the EP process by means of:

(1) verifying that the desired aim-voltage on the photoconductor (set by the densitometer as primary sensor) is indeed achieved. The electrometer measures the actual film voltage. The programmed control compares the actual film voltage with the aim voltage and corrects the primary grid setting.

(2) calculating the actual charger efficiency. The programmed controller calculates the charger efficiency given by the ratio of the actual film voltage and the actual primary grid setting.

As the electrophotographic (EP) process setpoints change to keep the density constant in response to varying Q/m of the developer, accuracy of the photoconductor's primary voltage in the typical range of 300V to 800V is achieved by measurement to compensate for manufacturer variability in the components involved, e.g. photoconductors, power supplies and A/D and D/A converters. The electrometer measures the photoconductor's actual primary voltage in every interframe. Subsequent readings are combined by the programmed control to form a running average for better accuracy and noise reduction in the EP process control setpoints. Electrometer readings are suspended by the programmed control whenever a patch is produced in the interframe and measured by the densitometer. Electrometer readings are ignored by the microprocessor, if the reading is outside the predetermined normal range.

The performance of the described EP process control system is further improved by calculating a parameter related to the charger efficiency for the charging system. The effective charger system efficiency is a function of the geometry (charger width measured in process direction, charger spacing measured as distance from the photoconductor), chemical composition of photoconductor and its thickness and ambient % relative humidity affecting the efficiency of the corona within the primary charger as well as the charge acceptance of the photoconductor itself.

Considering just the effect of relative humidity, the charger efficiency may vary about ±5% around an average efficiency determined by the remaining factors within one machine (for specific geometry). The efficiency is smallest (inverse efficiency highest) for humid environments and increases to highest efficiency (inverse efficiency lowest) as the machine internal temperature rises and, therefore, lowers the relative humidity within the machine. Obviously, machine to machine variability will affect the average charger efficiency because of mechanical variability in the mounting of the charger. The variability in charging efficiency expressed in percent, corresponds to a relative error in film voltage of the same amount, e.g., at high % relative humidity with high charging developer, high film voltages are necessary to keep the density constant. For this condition, the charger efficiency is low by 5% causing the film voltage to be low by about 40 volts where film voltages $V_O$ are to be 800 volts. Similarly, at low % relative humidity the film voltage will tend to be high.

The calculation of the actual charger system efficiency (ratio of actual film voltage and grid setting) or as noted its inverse constitutes an improvement making the process insensitive to % relative humidity variation as well as variability in charger geometry introduced by its mechanical assembly and mounting. This allows for more suitable settings for development station voltage bias $V_B$ and provides for improved rendition, particularly of images with lighter density tones.

In accordance with the invention described in aforementioned U.S. application Ser. No. 08/799,673, filed Feb. 11, 1997, there is implemented a third EP setpoint in addition to the setpoint for $V_O$ (film voltage) and $E_O$ (exposure). The tertiary setpoint is the bias offset delV=$V_O - V_B$. With the toning potential given as $V_{TON} = V_B - V_{EXPOSURE}$ wherein $V_{EXPOSURE}$ is the voltage level remaining in an image area after exposure, changes in the offset voltage delV affect the toning potential $V_{TON}$ by the same amount. However, the relative changes in toning potential vary greatly for various density levels. For light density levels, the toning potential, $V_{TON}$, is in the range of 0V to 50V, whereas for heavy density levels, e.g. $D_{MAX}$, the toning potential is in the range of 250V to 350V. Rather small bias offset adjustments in the range of −20V to +20V around an average of delV=110V have a rather large effect on the light density levels and no visible effect on the high density levels. The tertiary EP process control setpoint delV is a fine adjustment to the tone scale affecting the lighter density steps.

The three EP parameters, $V_O$, $E_O$ and delV, are derived from readings of interframe patches using $D_{MAX}$ patches and patches of levels less than $D_{MAX}$. To this end, a schedule of interframe patches is implemented to change the density levels of the interframe patches under control of the process controller. The resulting readings are then compared with the appropriate aim voltage of that level and the setpoint is changed accordingly. With the maximum density at aim, lighter than desired density levels in the lower half of the tone scale require a decrease in bias offset voltage delV; darker than desired density in the lower half of the tone scale require an increase in bias offset voltage delV.

The above-described process control method and apparatus thus provides a robust control process of EP process parameters with elimination or at least the reduction of image creation variability due to changes in temperature and humidity and other process conditions as encountered in use of an electrophotographic apparatus. Calculations of the various parameters may be made using a computer forming a part of a programmed control or by use of dedicated calculating or logic devices or through use of tables such as lookup tables.

Control of Transfer Current

Figure 3B:
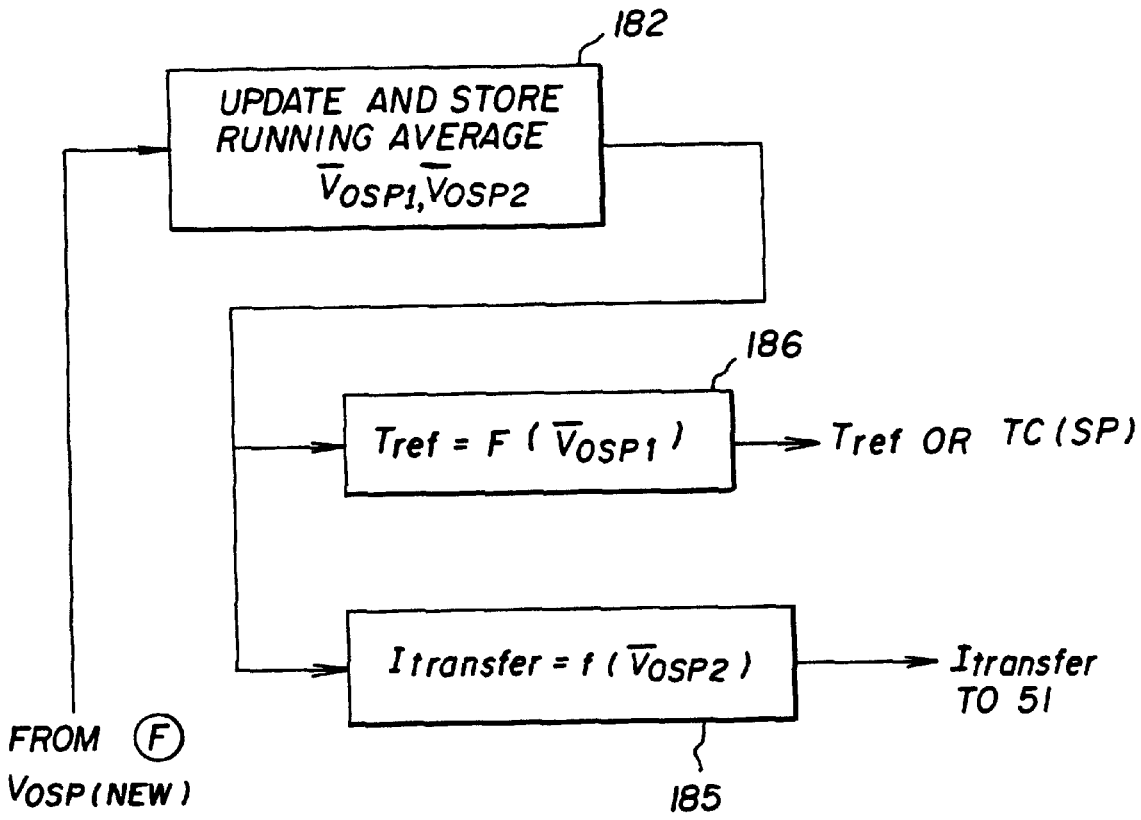
Figure 5:
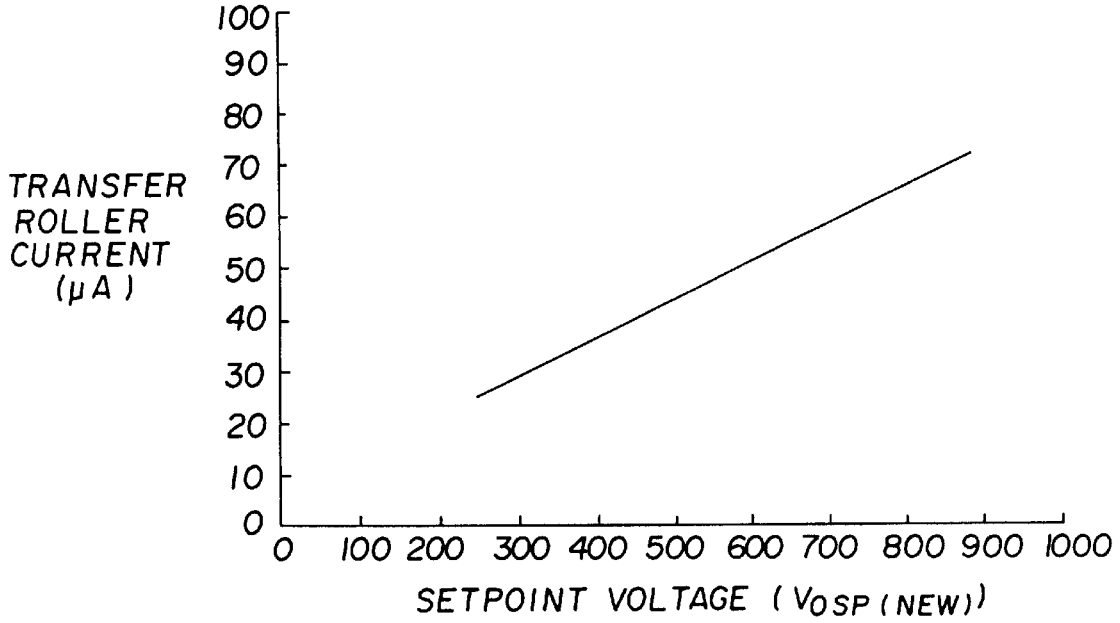
FIG. 5 is a similar graph to that of FIG. 4 but illustrating a relationship between primary charger setpoint voltage and transfer roller current.

With reference now to FIG. 3*b* and to the graph in FIG. 5, the determination by the LCU 24 of an updated $V_{OSP(NEW)}$ or running average of $V_{OSP}$, $\overline{V}_{OSP}$ determined by a control patch reading is also used by the LCU to generate an updated transfer roller current, $I_{transfer}$, step 185. In the example shown in FIG. 5, a linear relationship has been found suitable to adjust transfer current in response to $V_{OSP(NEW)}$. It will be understood, however, that the relationship is experimentally determined and that other systems may have a non-linear relationship between primary voltage $V_O$ or other EP process parameter and transfer roller current. Where running average of $V_{OSP}$ (denoted $\overline{V}_{OSP2}$) is used a formula for determining the running average is provided in equation (17) below, except that a different value for n is used to provide a faster response to changes in $V_O$ setpoint and thus faster changes in $I_{transfer}$. A specific straight-line relationship between $V_{OSP}$ and transfer roller current found suitable for one apparatus is:

$$I_{transfer} = 1.871 \cdot \left(\frac{16}{400}\right)(0.958 \cdot [\overline{V}_{OSP2} - V_{anchor}]) + I_{anchor} \tag{16}$$

wherein $V_{anchor}$=522 volts and $I_{anchor}$=45 $\mu$a.

While a relationship between $I_{transfer}$ and $V_{OSP}$ determined using the densitometer is shown in equation (16) and preferred, the important feature is that a parameter determined from reading of a toned patch which is used for generating process control parameters $E_O$, $V_B$ or $V_O$ bears some relationship with transfer roller current. The preference for use of $V_O$ setpoint or running average thereof to determine $I_{transfer}$ is because $V_O$ changes the most compared to the other EP process setpoints and thus numerical accuracy is best for this setpoint.

With determination of an adjustment to a process control parameter value for image formation on the primary image-forming member, the adjusted value is used by the LCU to determine a new transfer current value. This setting of a new value of transfer current may be calculated from a formula or empirical values and may be stored in a look-up table memory and determined from such table.

With reference now to U.S. application Ser. No. 08/841,008 filed on Apr. 29, 1997 in the names of Francisco L. Ziegelmuller, George R. Walgrove and David E. Hockey and entitled "Transfer Roller Electrical Bias Control," the contents of which are incorporated herein by reference, after transfer current is adjusted to the calculated setting value and during the initial movement of a receiver sheets into the nip formed between the transfer roller 47 and the photoconductive belt 18 supporting the toner image, the transfer voltage applied by the transfer roller power supply 55 to the transfer roller for generating the determined constant transfer current level is sensed. The transfer roller power supply is locked in at the constant current setting during transfer of an image to a receiver sheet. After the image is transferred to the receiver sheet, the power supply enters a constant voltage mode, stores the sensed transfer voltage in memory and then switches polarity of the sensed voltage value when the interframe area of the photoconductor belt is in the transfer nip area to block transfer of the toned patch to the transfer roller. As the next toner image bearing image frame arrives in the transfer nip, the polarity of the voltage switches back to that suited for transfer and at the same voltage value as previously stored in memory. The power supply then returns to the constant current mode for transfer of the next image. The reason for switching from constant current mode to constant voltage mode is that rapid changes in polarity of a typical power supply are preferably made from a constant voltage mode.

Figure 4:
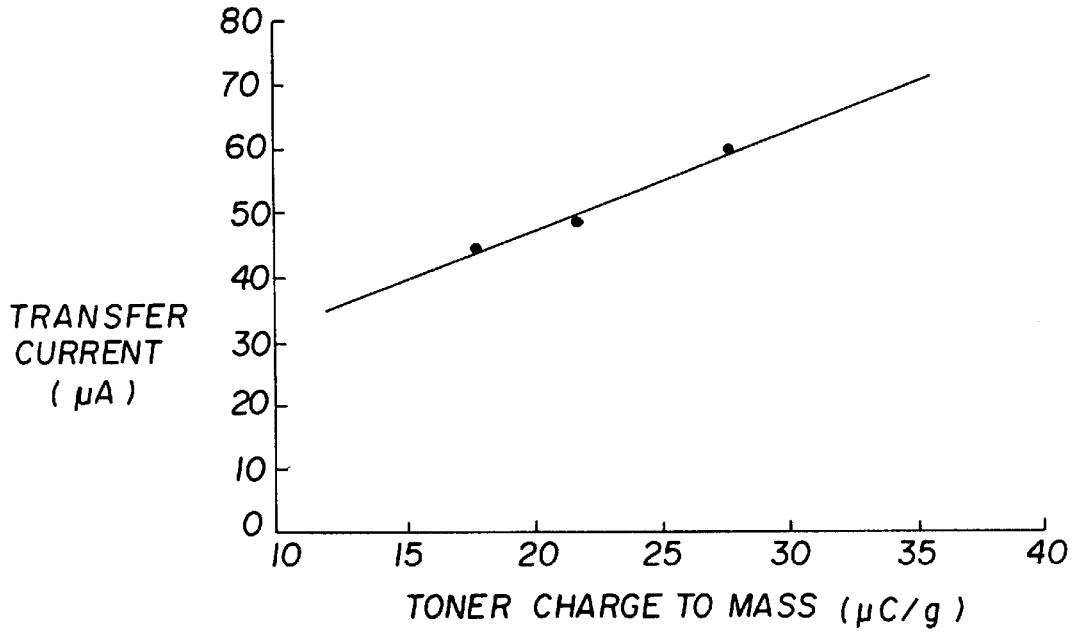
FIG. 4 is a graph illustrating a relationship between charge to mass and transfer roller current in accordance with cross-referenced case #2.

With reference again to FIG. 1, as an alternative to using a relationship between a process control parameter and transfer current to change transfer current, the charge to mass ratio may be sensed directly and used to adjust transfer current. In this regard and as an illustrative but not preferred example, an additional electrometer 50*a* may be located after the development station 38 to measure the charge on a developed process control patch area. The charge to mass ratio may then be calculated directly by using the electrometer reading 50 of the primary charge voltage less the voltage on the developed patch area and dividing this by the signal $D^k_{OUT}$ such as for a reading of a $D_{MAX}$ patch area. Alternatively, measurement of the toning bias current during the development of the process control patch is a direct measure of the toner charge. The current reading normalized by the patch size and divided by the mass laydown (determined from densitometer readings) yields Q/m. This ratio will be related to charge to mass since there is a known relationship for a specific toner between density and mass; thus, reference herein to a charge to mass ratio or parameter implies charge to density also. For each apparatus and toner, a relationship may be determined between charge to mass (or density) ratio and proper transfer current and conversion values stored in LCU 24. During operation of the apparatus as patches are created for adjusting EP process setpoints, a calculation of charge to mass or readings of the separate elements of this ratio may be input to the LCU and used to generate an updated transfer current in accordance with a predetermined relationship between Q/m and transfer current. As one example, see the graph of FIG. 4. The transfer current is changed accordingly as described above and improved transfer may result under otherwise adverse conditions of high charge to mass ratio. For toner used in the example, the high charge to mass ratio conditions occur at high humidity. Other methods for measuring charge to mass or charge and mass or some functional relationship involving charge and mass may be used in this regard; see for example, U.S. Pat. Nos. 5,235,388; 4,026,643 and 5,416,564.

As an additional alternative, read values of electrometer 50 and densitometer 76 may be input into LCU 24 and used to determine an update of transfer current more directly rather than relying upon a relationship between an EP process parameter and the transfer current.

Control of Range of Charge to Mass Ratio in the Development Station

In accordance with the invention and with reference again to FIGS. 6–8, the inventors have noted that an EP process setpoint ($V_O$, $E_O$ or delta V) can be used to infer Q/m of the toner and derive corrections/improvements to certain elements in the operation of the EP process. As noted above, excessive dusting of toner and hollow character formation in printed output can be observed when charge levels (Q/m) on the toner are relatively low due to certain environmental conditions. While low charge levels are typically representative of older toners, the phenomenon was observed for toner that was not old. In order to overcome this dusting problem at low charge levels, the toner concentration needs to be lowered at low Q/m in order to increase tribocharging. Rather than measure Q/m directly, the invention recognizes that there is a useful relationship between an EP process control setpoint parameter, preferably $V_{OSP}$, and a replenishment control signal value $T_{ref}$ (or in some embodiments a toner concentration setpoint value TC(SP)) that can be used to control replenishment and maintain values of toner charging (Q/m) within a desirable range that is not likely to create a dusting problem for moderately aged toners. The preference for connecting TC control with the $V_O$ setpoint (as compared to other EP setpoints) is because $V_O$ changes the most as a function of varying Q/M. Numerical accuracy is thus better obtained with the $V_O$ setpoint to control $T_{ref}$ or TC(SP).

Figure 9:
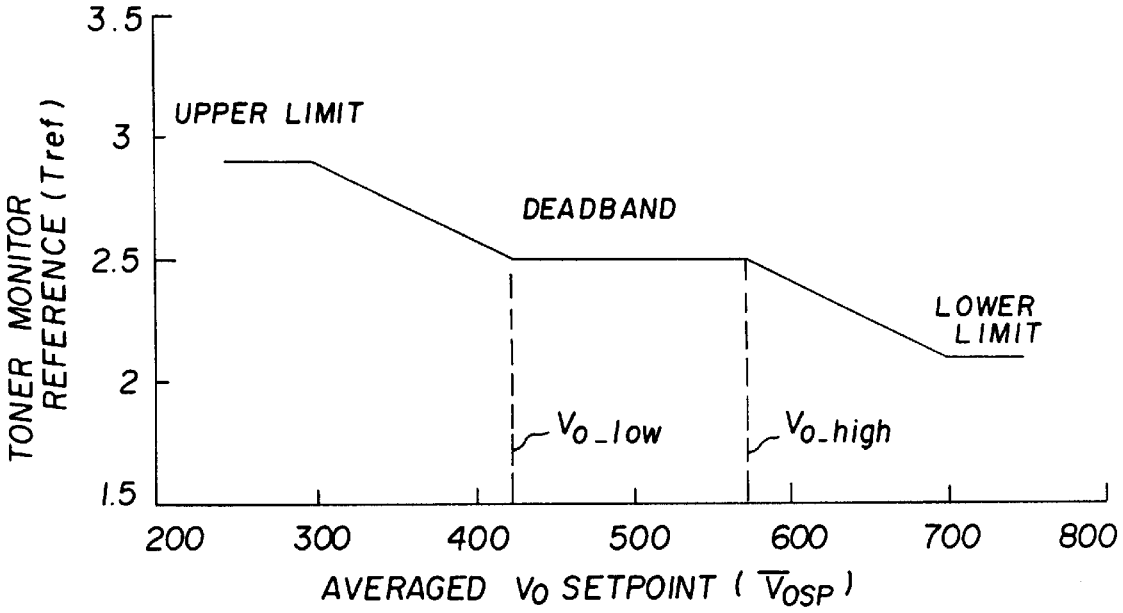
FIG. 9 is a graph illustrating a relationship between an EP process control variable, averaged $V_O$ setpoint ($\overline{V}_{OSP}$), and a toner concentration reference control signal $T_{ref}$

With reference now to FIGS. 3*b* and 9, as updated new values of $V_{OSP(NEW)}$ are generated in response to reading of the density of the process control patches, a new $T_{ref}$ can be calculated to yield a predetermined, desired relationship between these values. Such relationship is shown as an example in FIG. 9. Since the adjustment of the average TC is intended to improve performance at high and low charge conditions, the setpoints for $V_O$ are averaged such that environmental variations e.g. as they occur during one day of operation are not averaged out. With process patches programmed to occur e.g. every 100 frames and production of 100 prints per minute, daily swings in the EP setpoints due to environmental conditions are followed using an averaging e.g. over one hour, step 182. For the given patch frequency and productivity, such hourly averaging is realized with n=60 by:

$$\overline{V}_{OSP1} = \frac{1}{n} V_{OSP(NEW)} + \left(1 - \frac{1}{n}\right) V_{OSP(OLD)} \tag{17}$$

Figure 6A:
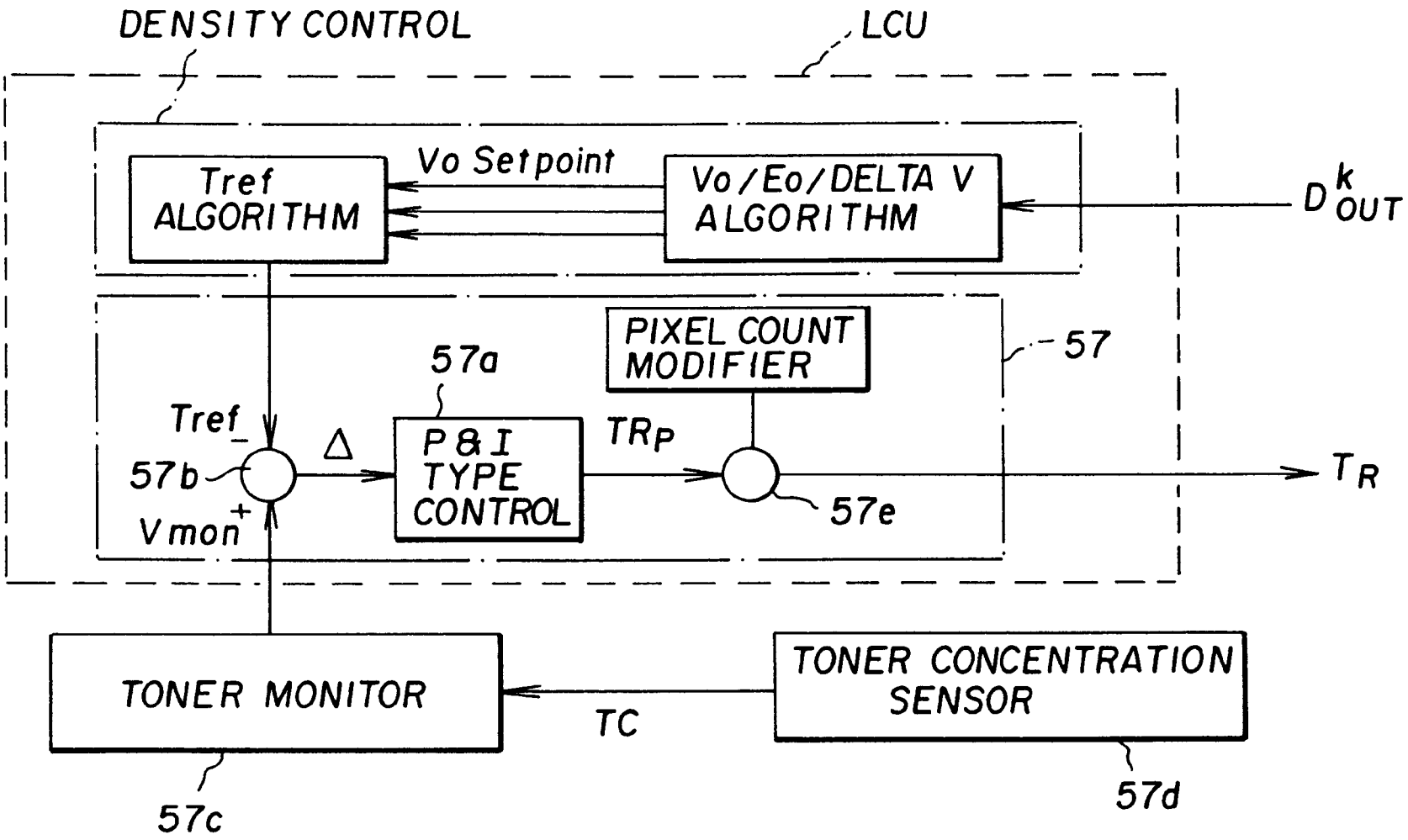
FIGS. 6A and 6B are alternative schematics of a toner concentration (TC) controller for use in the apparatus of the invention.
Figure 6B:
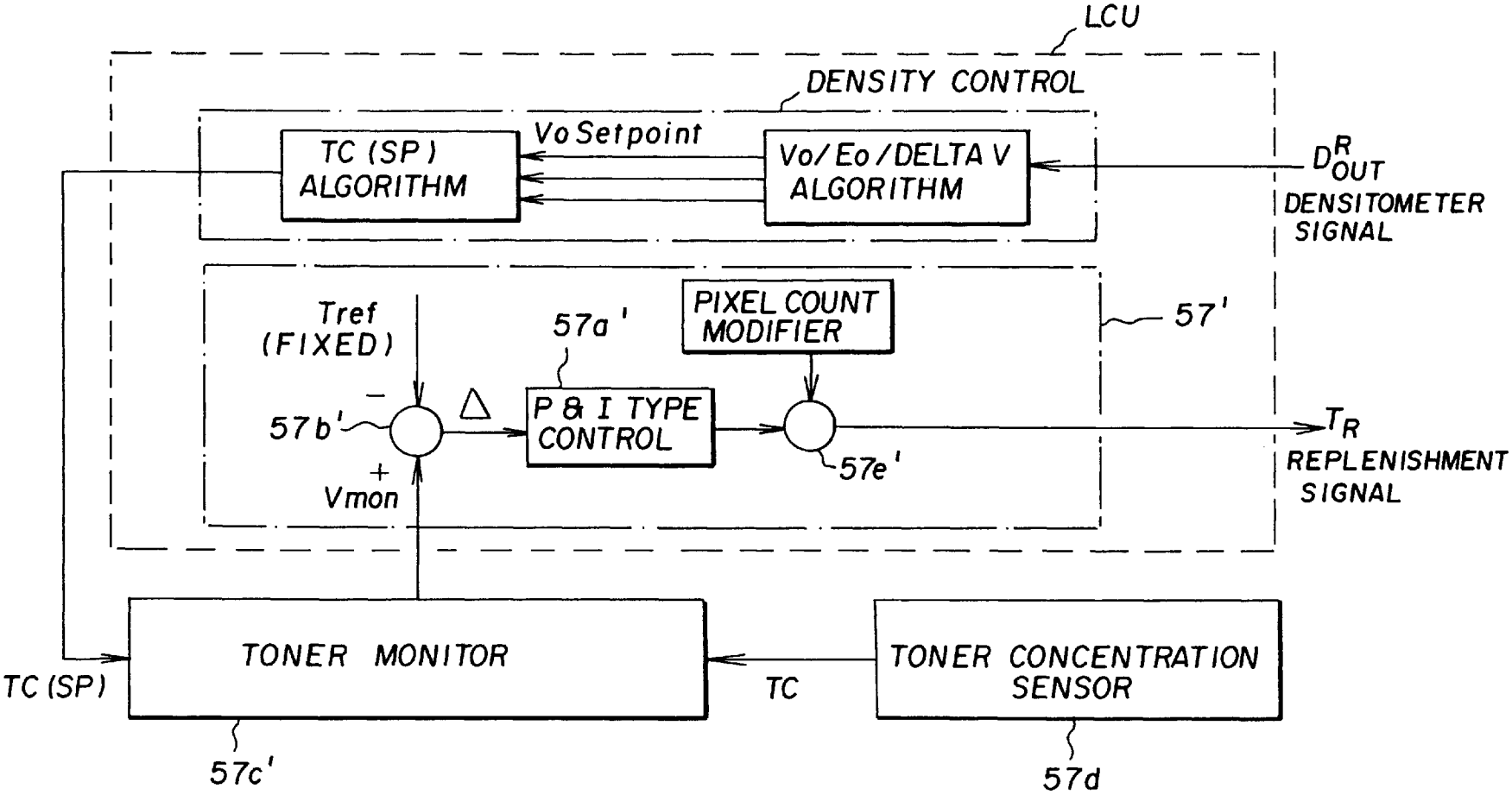

To realize the desired adjustment in toner concentration as e.g. shown in FIG. 9, the averaged setpoint for $V_o$, denoted $\overline{V}_{OSP1}$ in FIG. 3*b*, is used in a functional relationship (step 186) and programmed into the logic and control unit. With reference also to FIG. 6A, as may be seen in the context of a controller 57 which may form part of the LCU, hourly and daily changes to the replenishment are controlled by varying $T_{ref}$ as a function of the averaged $V_O$ setpoint whereas print-to-print variation in toner usage relative to the replenishment can cause TC to change quickly, producing rapid changes in the $V_{MON}$ signal.

The signal $V_{MON}$ output by toner monitor 57*c* is compared by a comparator 57*b* with the signal $T_{ref}$ and a difference signal Δ is input to a proportional plus integral (P+I) type controller 57*a* or algorithm that operates as such a controller. The P+I controller is tuned for a relatively fast response to input signals Δ. Like $V_{MON}$, Δ may change quickly owing to print-to-print variation in toner usage. The output from the P+I controller 57*a* represents a preliminary toner replenishment signal TRp. The signal TRp may be modified in block 57*e* with a signal that provides adjustment for toner take out based on pixel count to generate the replenishment signal TR. Where the exposure system relies on electro-optical exposure of the photoconductive belt the take out of toner will be related to the number of pixels exposed, assuming that this is a discharged area development process. Where the electro-optical exposure source is of a gray level or multibits per pixel, the count signal may keep track of accumulating grey level exposures and weigh the count accordingly so as to be related to toner take out. The use of pixel counting to modify a toner replenishment signal is known, as discussed in U.S. Pat. No. 5,649,266, and is considered to be optional to the process and apparatus of this invention.

In operation, a reduction or increase in toner concentration is affected by the running average of the $V_O$-setpoint which implies or infers conditions likely for dusting or hollow character formation at low toner charge (low EP setpoints) and conditions likely for breakdown and transfer mottle at high charge (high EP-setpoints) A reduction in toner concentration is implemented by a proportionate raising of $T_{ref}$ (FIG. 6A embodiment) or a suitable lowering of TC(SP) (FIG. 6B embodiment) so as prints are being made, the toner concentration is allowed to fall. With lowering of toner concentration, the toner charge (Q/m) increases and conditions of dusting and hollow character are reduced. An increase in toner concentration is implemented by a proportionate lowering of $T_{ref}$ or a suitable raising of TC (SP) (FIG. 6B embodiment) so as prints are made, more toner is added than taken out. With increasing the toner concentration, the toner charge to mass ratio (Q/m) decreases and conditions of transfer mottle and high film voltage $V_O$ (causing dielectric breakdown) are reduced. Rather than adjusting $T_{ref}$ continuously as a function of the averaged $V_O$-setpoint, improved performance according to this disclosure was found, if increases in toner concentrations were made only for the highest averaged setpoints (above $V_{O\text{-}high}$) and reductions in toner concentrations only for the lowest averaged setpoints (below $V_{O\text{-}low}$). The preferred embodiment of the toner concentration control according to this invention is pictured in FIG. 9. The example of FIG. 9 could provide an effective parametric relationship for limiting the range of toner charge (Q/m) to the preferred operating range of 17–23 μC/g for the exemplary process. Other relationships could also be used. A parametric relationship using the toner monitor control of FIG. 6B may also be developed that would provide a dead band of coverage where no change to TC(SP) occurs when $V_{OSP}$ is in the range between $V_{O\text{-}low} \rightarrow V_{O\text{-}high}$ but adjust toner concentration setpoint accordingly to adjust $V_{MON}$ and thereby change replenishment to return toner Q/m to within range.

Figure 7:
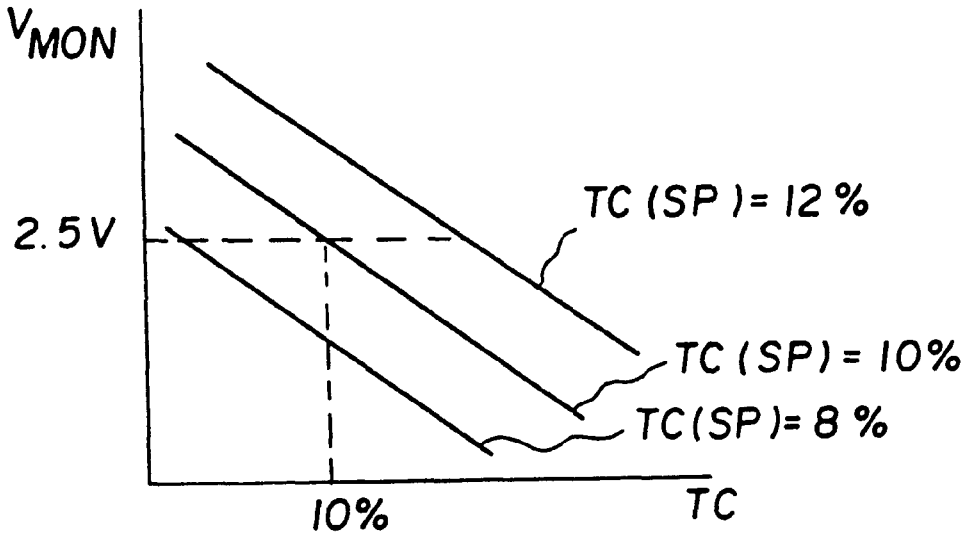
FIG. 7 (PRIOR ART)
FIGS. 7 and 8 are graphs illustrating a relationship between TC and a signal output by a TC monitor in accordance with the prior art.
Figure 8:
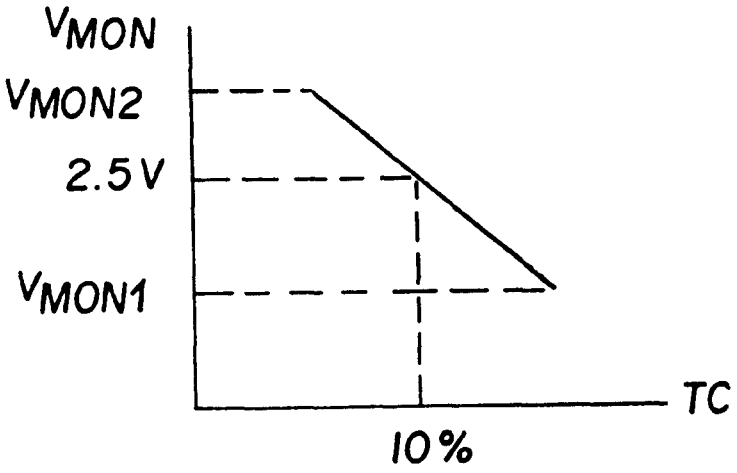
FIG. 8 (PRIOR ART)

The method and apparatus described may also be used with a toner monitor 57*c*′ of the type having a characteristic illustrated in FIG. 7 (FIG. 6B embodiment wherein a prime indicates a corresponding function to that of the corresponding structure of the embodiment of FIG. 6A); i.e., a parametrically adjustable relationship is provided between output voltage $V_{MON}$ and the measured TC. Where such a toner monitor is used, the signal $T_{ref}$ internal to the logic and control unit may be replaced by an analog control voltage output to the toner monitor as TC(SP) to change its input/ output characteristic. Since signals $T_{ref}$ and TC(SP) both can be used to affect the toner concentration, both signals can be used cooperatively or alternately. The use of such a toner monitor is described in U.S. Pat. No. 5,649,266, the pertinent contents of which are incorporated herein by reference. The use of either one of these toner monitors (FIG. 7 or FIG. 8) recognizes that the adjustment of $T_{ref}$ or TC(SP), either of which is considered a reference signal as the term is used herein, needs to be limited to the practical upper and lower operating limits for the toning process as schematically illustrated in FIG. 9. It will be understood that print-to-print changes in toner concentration are corrected by normal toner monitor control wherein changes to TC cause $V_{MON}$ to change and thus create a change to Δ. The replenishment signal TR that is generated in response to a change in Δ causes the replenishment motor control 43 to activate the replenishment motor 41 which drives the toner auger 39 to add toner to the replenishment station. However, where averaged $V_{OSP}$, $\overline{V}_{OSP}$, is outside of the deadband in FIG. 9 adjustments are made to $T_{ref}$ or TC(SP) or both to cause toner charge (Q/m) to return to the preferred operating range. Thus, in accordance with the invention an improved method and apparatus are provided for controlling toner charge to the preferred operating range.

Auto Set-up Routine

The auto set-up routine is started automatically after every power-up and is executed while the fuser is warming up. Ideally, the completion of the auto set-up routine will coincide with the ready state of the fuser after warming up. As the auto set-up routine is executed, messages on an operator control interface (OCI) will indicate which phase of the auto set-up routine is currently executing. The amount of messages and detail displayed may be determined by machine configuration; e.g. all details may be only displayed in a "service mode", selected details may only be displayed in customer sites with "key operators" able and trained in selected maintenance procedures, and only status messages may be displayed in a "walk-up environment". Upon completion of the auto set-up routine, a message on the OCI will indicate successful completion or display a list of errors encountered. The machine will cycle out during any phase of the auto set-up routine if a serious error is encountered. An appropriate error message provided on the OCI will indicate the problem and possible actions to be taken by the operator.

As part of the auto set-up routine, the fundamentally necessary electrical functions are verified. The primary charging process of the photoconductor is tested in conjunction with the generation of a compatible toning bias. This "power supply and electrometer test" is executed as part of the auto set-up routine and includes the variation of primary charging levels and toning station voltage bias levels over the entire operating range of the EP process apparatus.

An essential part of the auto set-up routine is that the developer mix is warmed and charged up to eliminate any further fast changes in charge-to-mass of the developer. This will allow that the patch frequency during the production run is minimized and problems with backside markings caused by the transfer system are minimized or preferably avoided altogether. In this context, the toning station's warmer 38*a* includes controls that allow the machine control software of the LCU 24 to interrogate the status and function of the toning station warmer. If the station's warmer is sensed to operate properly, a relatively small change in charging level and charging rate are assumed and a "short EP set-up" is executed as part of the auto set-up routine.

The software for the auto set-up routine may be structured such that each phase can be executed by itself as part of a diagnostic and/or service procedure.

Under normal conditions, the initialization of various data processing steps in the EP control software retrieves the last EP setpoints and EP parameters from memory. However, special conditions occur when the last EP data in non-volatile memory is not yet existing (e.g. at first power-up after assembly) or destroyed by component failure (e.g. battery loss). In this case nominal EP conditions are assumed and nominal EP setpoints, "anchor points", are loaded from permanent memory and utilized to initiate the data processing steps.

Another special condition occurs when the last EP data in non-volatile memory is corrupted by either partial component failure of the logic and control unit or EP hardware failure creating an unforeseen combinations of EP setpoints due to machine stoppage.

No matter what condition the EP apparatus is in, the EP setpoints are checked for consistency before they are applied to the actual EP process. Based on the invention described in U.S. application Ser. No. 08/799,673, all EP setpoint combinations of $V_O$, $E_O$ and delV are arrived at by adjustment in steps of fixed ratios. Therefore, any stored and retrieved last EP setpoint combination is related back to the nominal EP conditions (anchor points"), by their respective ratios. With the EP setpoint for $V_O$ changing the most (largest coefficient), the EP setpoints for the other two ($E_O$ and delV) can be recalculated using their relative adjustment ratios according to:

$$V_{OSP(NEW)} = V_{OSP(last)}$$

$$E_{O(NEW)} = \frac{V_{OSP(NEW)} - V_{OSP(anchor)}}{\alpha^k}\beta^k + E_{O(anchor)}$$

$$\mathrm{del}V_{(NEW)} = \frac{V_{OSP(NEW)} - V_{OSP(anchor)}}{\alpha^k}\gamma^k + \mathrm{del}V_{(anchor)}$$

With the above recalculation of the EP setpoint combination, the setpoints are re-synchronized (in this case to $V_{OSP(last)}$ for highest numerical accuracy) and desired tone scale reproduction is ensured. Rounding errors accumulating over time due to limitations of the logic and control unit are reset and, thus, limited with every execution of this phase in the auto set-up program. $E_O$ (new) is determined in units of GREF numbers as noted above.

Figures 13, 13A:
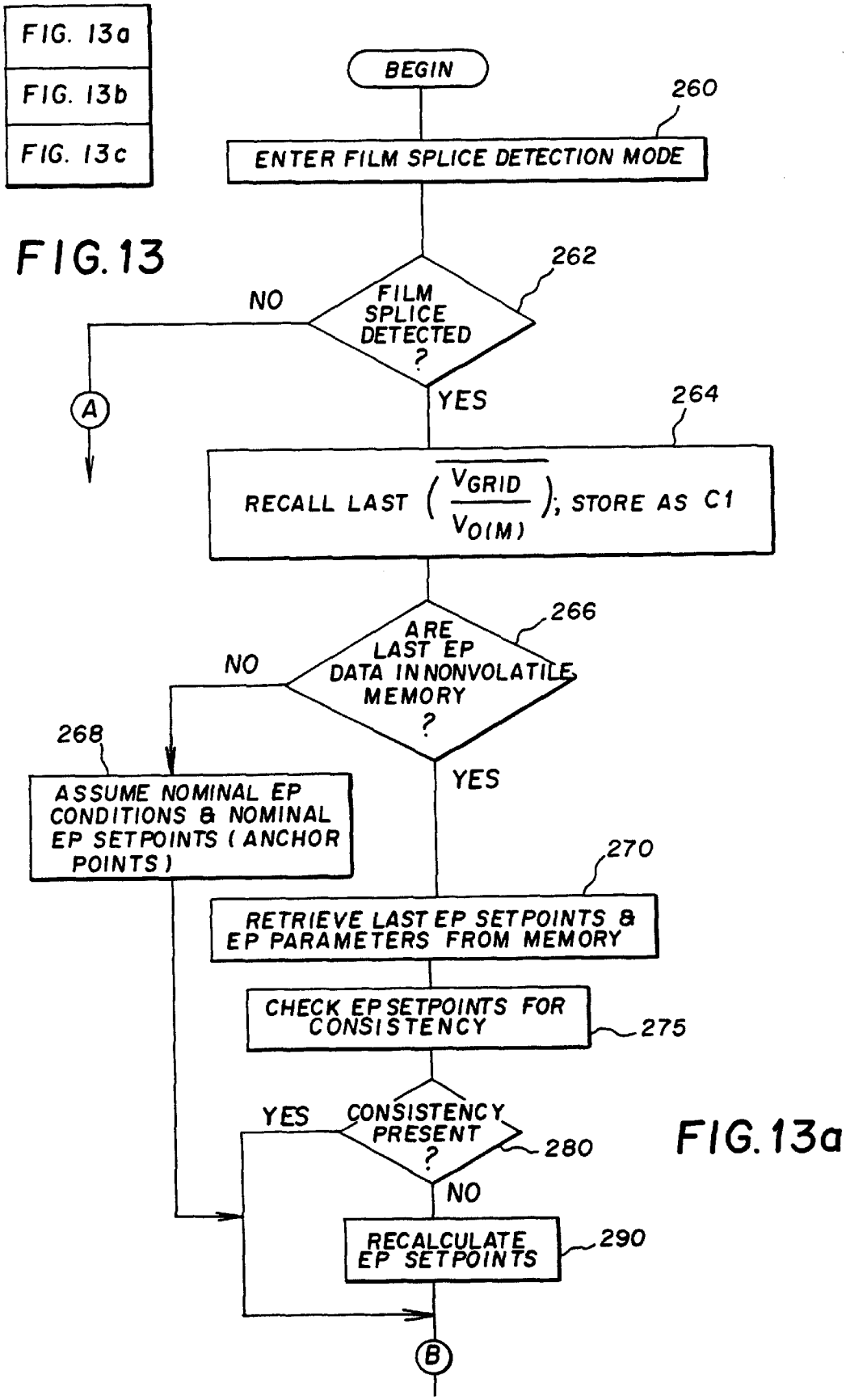
FIGS. 13 (*a, b* and *c*) is a flow chart of the auto set-up routine.
Figure 13B:
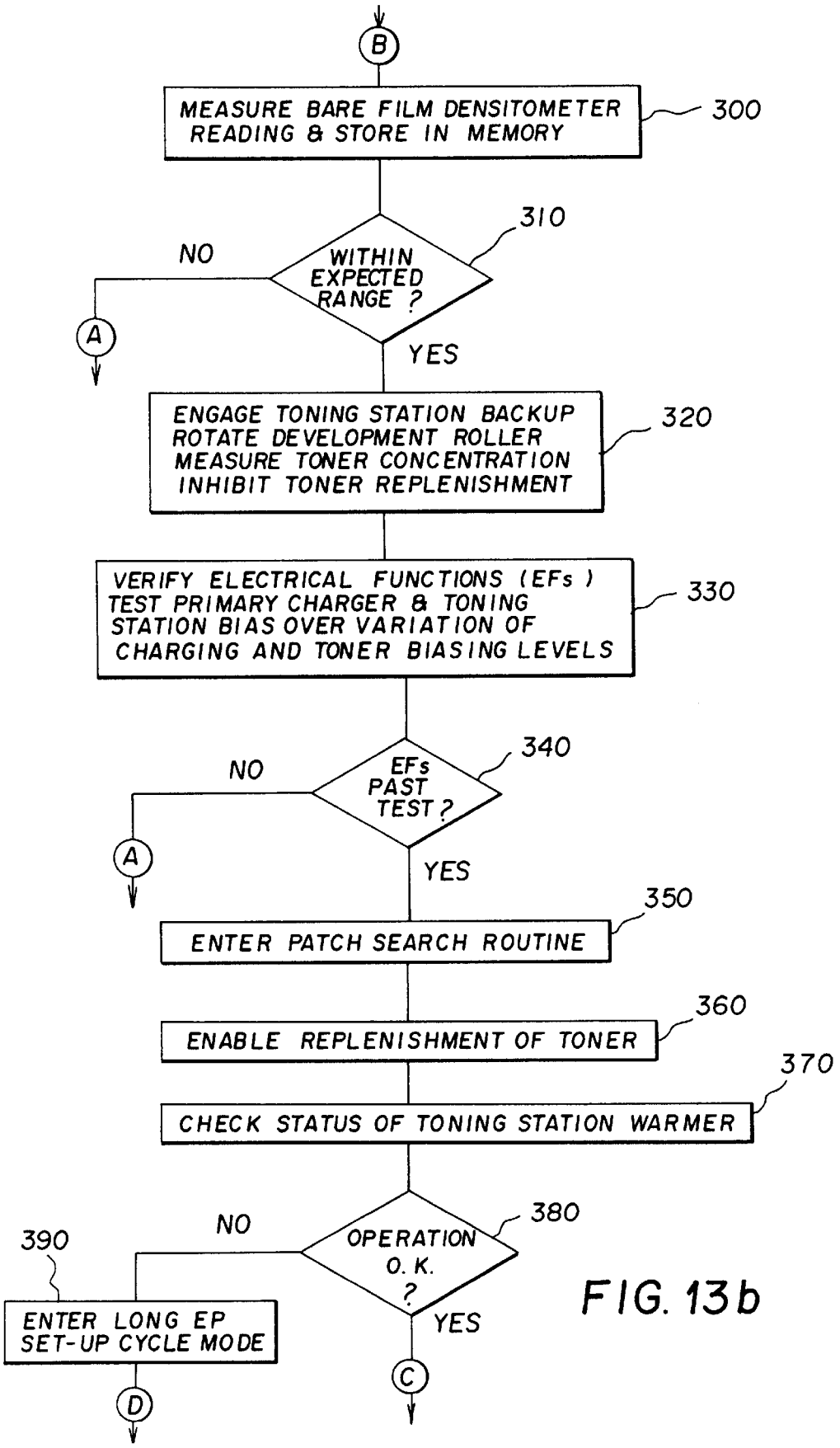
Figure 13C:
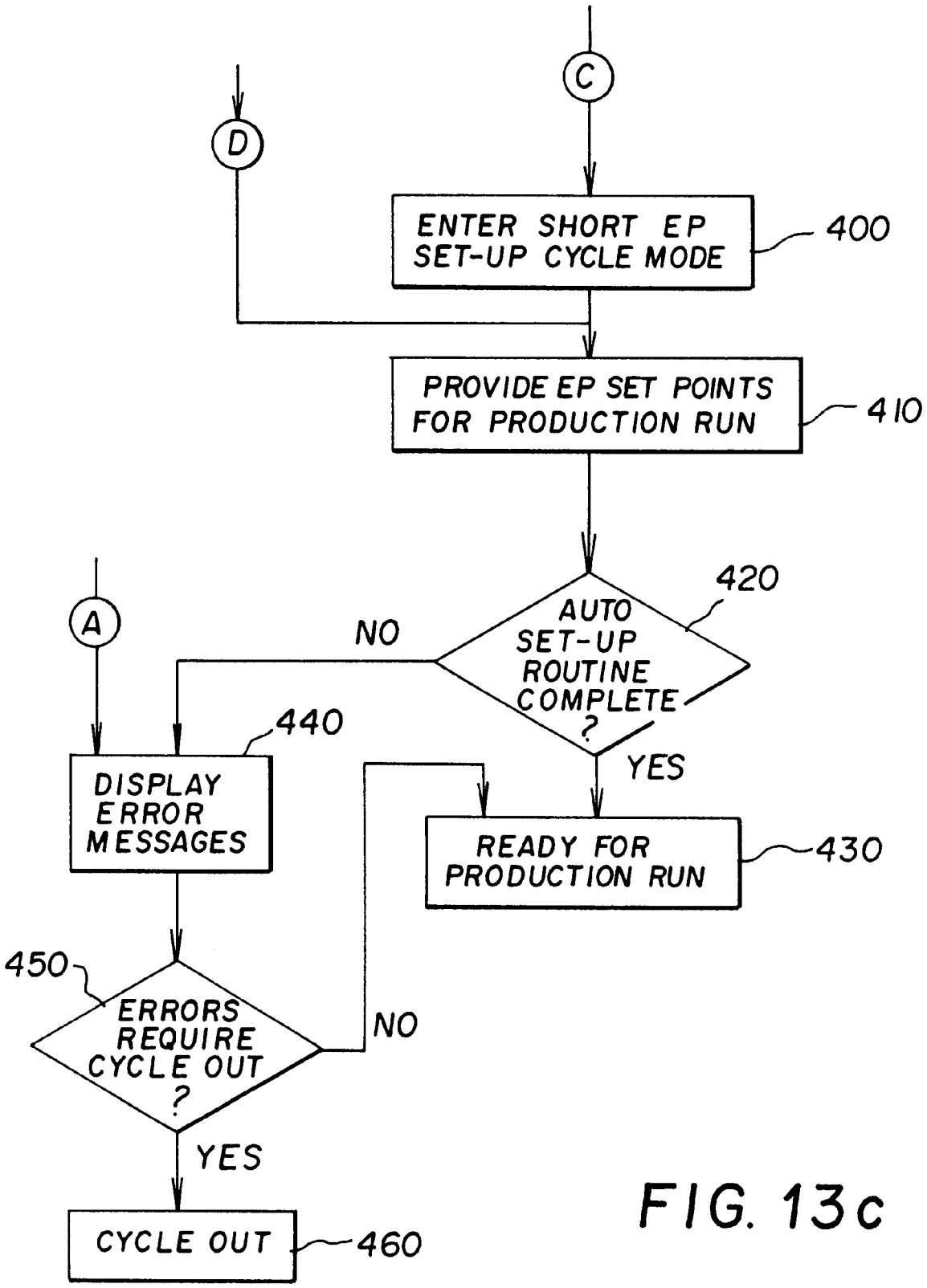

Description of the auto set-up routine will be provided with reference to the flow chart of FIGS. 13*a, b* and *c*. The auto set-up routine commences with a detection of the film splice that connects the ends of belt 18 (step 260). Timing of all electrophotographic and image creating subsystems is derived from encoder pulses and synchronized on every film splice of the film or belt 18 or a mark upon a photoconductive drum. Film splice together with encoder pulses provide the master timing for the machine. Failure to find the splice will result in cycle out (step 262). Error messages with suggested actions for the operator will be displayed. The encoder pulses are generated in response to sensing frame and splice perforations at an edge of belt 18. In response to sensing a frame perforation the encoder generates clock pulses representing movement of belt 18 between frame perforations as is well known.

After detection of the film splice the last running average of inverse charger efficiency is recalled from memory and stored as C1, step 264. The nonvolatile memory is checked for last EP setpoints step 266. If not present nominal EP conditions and setpoints are assumed, step 268. If present, the last EP setpoints and parameters are retrieved from memory, step 270. The EP setpoints are checked for consistency $\alpha^k/\beta^k/\gamma^k$ a predetermined fixed ratio, steps 275. If consistency not present the EP setpoints may be recalculated as discussed above step 290.

The bare film densitometer data is measured in response to periodic readings by densitometer 76 and stored as reference in memory. About 400 readings may be taken along the film loop and stored in memory. The average of all bare film readings is calculated and compared with a window of normal (expected) readings stored in memory, steps 300, 310. Depending on the result of this comparison, error messages will be displayed indicating densitometer contamination and/or densitometer (hardware) failure. The threshold for densitometer contamination is previously established and hard coded in the LCU. Machine operation (specifically print production) with densitometer readings at or above the threshold need not be blocked, however it may be indicative of low charging developer (e.g. at the end of its life) causing high level of machine contamination. Messages suggesting preventive maintenance by "key operators" is initiated upon reaching the densitometer threshold voltage. During the first two phases, the toning station back-up 38*b* is not engaged and the toning station development roller is not turning. This is to ensure that toner dusting out of the station or problems with the primary and/or development station bias power supply cannot affect the result of the splice search and bare film reference.

Figure 10:
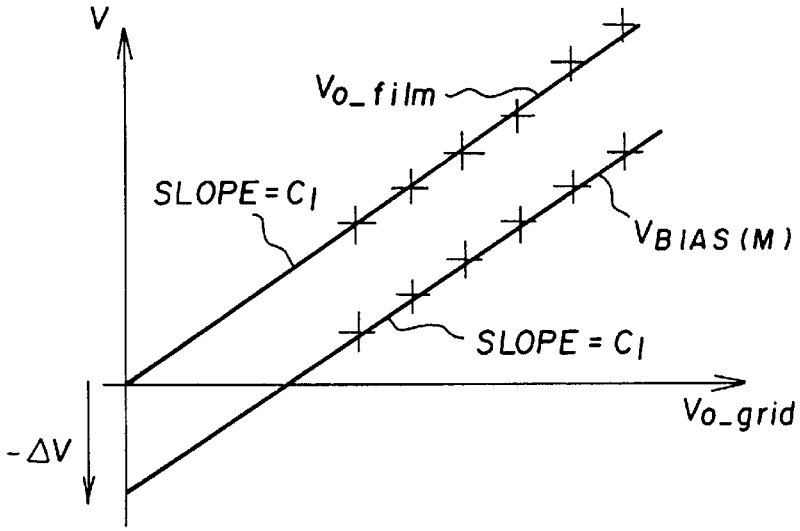
FIG. 10 is a graph illustrating an example of data obtained during an auto set-up routine for process control.

The toning station back-up 38*b* is now engaged, the toning station development roller also begins to turn and the toner monitor 57*d* measures the toner concentration. However, replenishing of any toner remains suppressed, step 320, until electrical function of the electrometer and power supplies are verified. Prior to the actual electrometer calibration and power supply checkout, the latest primary charging efficiency is measured and locked in for the duration of this routine. The inverse of charger efficiency is denoted $C_1$ as described above. As part of the power-up procedure, an electrometer calibration is performed by the machine, step 330. The machine applies various primary grid voltages (in the range of 350V–650V) and the resulting film voltage is measured with the on-board electrometer 50. A total of 35 readings may be taken and stored in memory. Linear regression of $V_{O_grid}=f(V_{Ofilm})$ yield inverse charger efficiency (slope) as well as the electrometer offset which should be zero when $V_{O_grid}$ is zero (see FIG. 10) (intercept). At the same time, the read back of the toning station bias supply is monitored. Again a total of 35 readings are taken. Linear regression of $V_{O_grid}=f(V_{Ofilm})$ yield again (see FIG. 10) the inverse charger efficiency (slope) and the bias offset (intercept). If primary and development station bias power supplies together with the electrometer are operating within the specifications, the two values for the inverse charger efficiency (slope) should be identical and the measured bias offset $\Delta V$ should be identical to the desired, programmed offset of for example $\Delta V=110V$. The correlations of (1) the electrometer 50 readings against the applied primary charger grid voltages and (2) the development station bias read back voltages against the applied grid voltages should both always be close to K=1.00 since they are independent of the inverse charger efficiency (slope). The development station bias voltages are read using circuitry associated with the power supply 40. In the software, the desired and programmed offset $\Delta V$ are subtracted from the calculated intercept and the result is compared to zero volts.

With some small allowances for errors (limited A/D resolution, specification tolerances, electronic noise, etc.), the EP control software checks for these conditions. Appropriate error messages can indicate failure in this routine and are related to machine problems. Depending on the error conditions and/or their combination, messages are displayed for the operator with most likely causes and suggestions of actions to resolve the condition. With this step completed successfully, the absolute necessary electrical conditions for electrophotography (for charging and toning) are checked, step 340.

If a tensioning roller is between the LED print head and the densitometer, the time between the interframe (IF) patch being written by the LED writer and the toned interframe (IF) patch being measured by the densitometer might vary after belt change. To establish accurate timing, the EP control software includes a patch search routine, step 350, which measures the actual time between LED writer and densitometer. The profile of the patch and its average value are verified by the software, before the actual timing is calculated and stored in memory. Since the absolute value of the densitometer read back value cannot be predicted, an algorithm to determine the exact timing between exposing the process patch using LED writer 34 and measuring it with the densitometer does not use any specific read back voltage. The algorithm may calculate the first derivative of densitometer 76 taken including the actual process patch. The rising and falling edge of the densitometer reading of the patch give rise to a maximum and minimum in the first derivative. With the absolute minimum and maximum checked and found to be larger than the noise threshold of the system, the process patch timing is centered between maximum and minimum of the first derivative. Multiple densitometer readings for each patch may be taken and averaged to improve the signal-to-noise ratio. The actual timing of the valid patch reading can be adjusted such that the center of all readings coincides with the center of the patch. Thus, if five readings per process patch are taken the third reading will coincide with the center of the process patch.

The status of the toning station warmer 38*a* is checked by reading status data from the warmer's controller forming a part of the warmer, step 370. A short EP set-up of 100 frames will be initiated if the station warmer is functioning properly. In case of an error, a long EP set-up of 300 prints will be initiated. Appropriate error messages regarding the status of the toning station warmer may be displayed on the OCI.

The replenishing of toner is now enabled, step 360. The re-synchronized EP control setpoints ($V_{OSP(NEW)}$), $E_{O(NEW)}$, $V_{B(NEW)}$ are applied and the EP control software begins adjusting them so that the measured density (in volts of the densitometer patches) yield the desired aim voltage for the IF patches. The IF patch frequency is set to 1 patch for 14 image frames for this EP control set-up. Depending on the status of the toning station warmer in the inferred conditions regarding charging level and charging rate either a "long" or "short" EP control set-up is executed, step 380. During this EP set-up cycle, all EP process error messages related to the rate of EP adjustments and/or the limits of the EP setpoints are suppressed. Since no output copies are produced, these error messages may be used during the production mode of the machine to assist in the troubleshooting of image artifacts. Hardware problems can be detected and, if detected, the marking engine made to cycle out and an appropriate error message(s) displayed.

Figure 11:
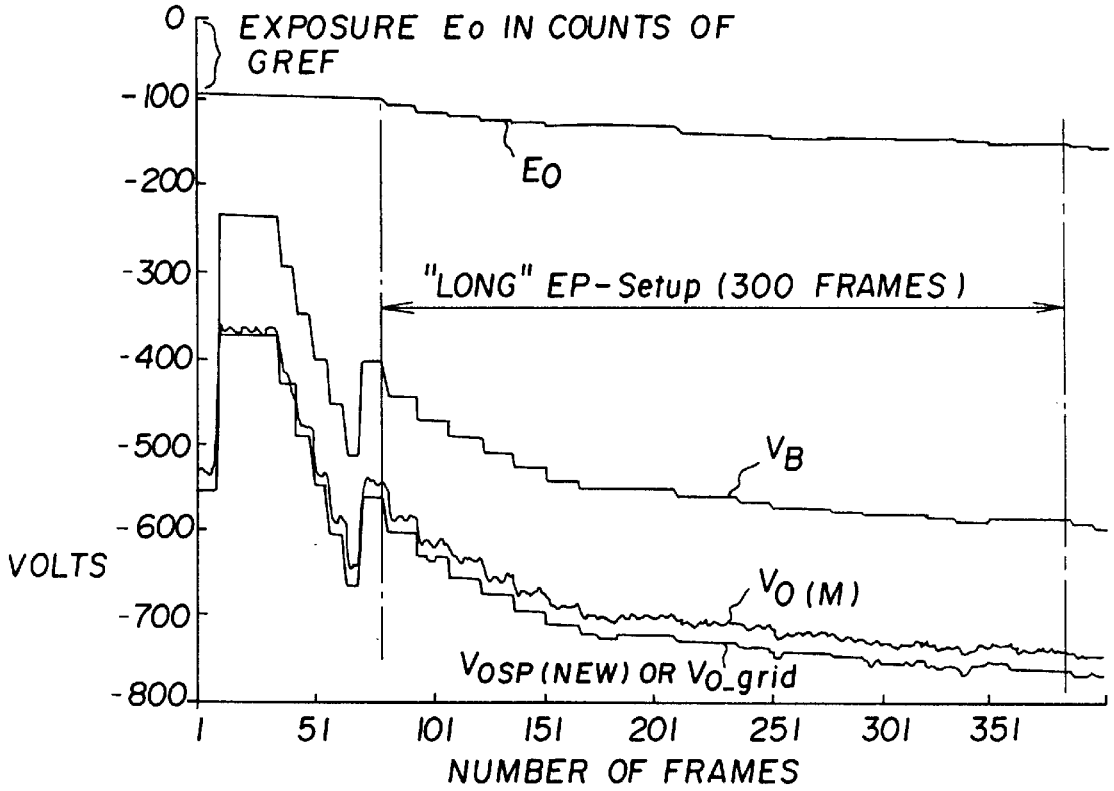
FIGS. 11 and 12 are examples of graphs of various EP operating parameters during the auto set-up routine to show respectively conditions when a toning station warmer is not operating and when the warmer is operating.
Figure 12:
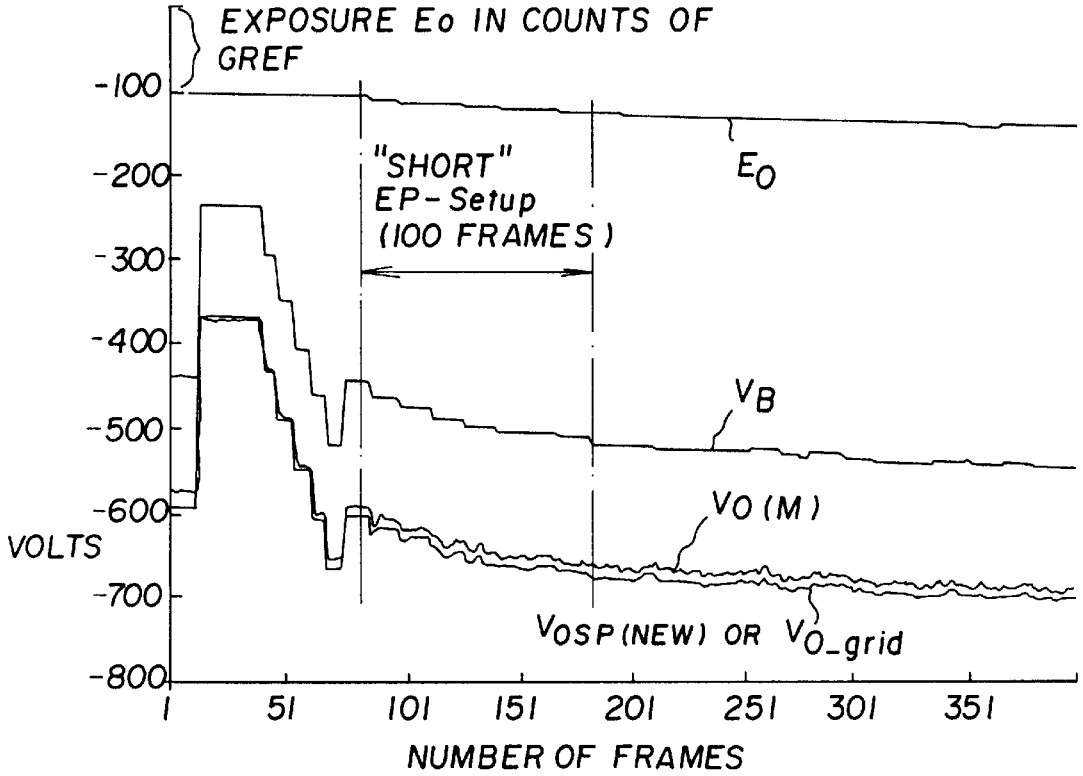

In comparing the data plotted in FIGS. 11 and 12, it becomes apparent that the setpoints without the toning station warmer operating (FIG. 11) are significantly higher than with the toning station warmer operating. The setpoints are directly related to the charge (Q/m) of the toner.

In the data shown, the toner used exhibited a high charge condition at high relative humidity (warmer not operating) due to its formulation. Consequently, after extended rest in high humidity, e.g. overnight, tribocharging of toner particle in presence of adsorbed moisture results in rather high charge during the first few hundred frames. More importantly, the increase in charge during the first few hundred frames is rather large, requiring frequent process control patches to stabilize the density. The length of the employed "long" EP set-up routine is selected such that for the toner used a maximum and stable toner charge is reached at the end of the "long" EP set-up, step 390.

In contrast to the EP set-up without a toning station warmer, the adsorption of moisture into the developer mix is reduced during long periods of rest, e.g. overnight, if the toning station is maintaining operating temperature of the toning station during periods of rest. As can be seen from FIG. 12, maximum charge of the toner is significantly reduced as indicated by the EP setpoints necessary to stabilize the density. Maximum charge level of the toner is reached at about one-third of the frames. Therefore, the employed "short" EP set-up is only about one-third of the "long" EP set-up, step 400.

In FIGS. 11 and 12 the first portion of each graph represents calibration to determine operativeness of the primary charger and bias $V_B$ to the development station. The vertical line at about 80 frames represents the end of the portion of the auto set-up routine for determining satisfactory operation of the primary charger the bias potential ($V_B$) to the development roller, the bare film belt densitometer readings and other preliminary determinations described including proper operation of the toning station warmer. If these check out satisfactory the EP process setpoints are set as described above. A determination is then made to commence either the long EP setup of 300 image frames in length (note a toned density patch is only provided 1 in every 14 image frames and no images are created in the image frames during the setup). Where the toning station warmer is operating properly the short EP—setup of only 100 frames typically results in the EP setpoints achieving stability or equilibrium, whereas in the case of the toning station warmer not properly operating the achieving of stability in the EP setpoints is not achieved until near the end of the 300 frames in the longer EP—setup. Thus, by determining proper operation of the warmer the time for making the first copy or print from the apparatus which has been idling can be shortened. The EP—control setup can continue for 20 more frames after the short or long setup to examine at least one more process patch and make adjustment of EP process parameters. The auto setup is then complete, step 420, and any error messages can be displayed to indicate machine conditions which may be considered as part of preventive maintenance, step 440. At this time the error messages do not represent hardware failures that otherwise would have caused the machine to cycle out, steps 450, 460. If the errors detected do not require cycle out, the EP setpoints determined at the end of the set-up routine are stored in step 410 and the machine is ready for production of prints, step 430 at relatively low patch creation frequency, typically more that one hundred frames between patches being created and used for adjustment of the EP parameter setpoints.

The invention has been described in detail with particular reference to preferred embodiments thereof, but it will be understood that variations and modifications can be effected within the spirit and scope of the invention.

We claim:

1. An electrostatographic recording apparatus comprising:

an image recording member;

a primary charger that establishes a uniform electrostatic charge on the image recording member in accordance with a first operating parameter;

a recording device or devices that imagewise modulates the charge on the image recording member to form electrostatic latent images in accordance with a second operating parameter and to form a developable process control patch;

a development station that develops the electrostatic latent images and the control patch on the image recording member with toner in accordance with a third operating parameter;

a replenishment device for providing toner to the development station at a controlled rate in accordance with a replenishment signal;

a sensor that senses density of the control patch developed by the development station; and a controller responsive to density of the control patch and providing adjustments to the first, second and third operating parameters and controlling a reference signal used to generate the replenishment signal as a function of a parameter related to one of the first, second or third operating parameters and independent of a reading of a level of the uniform charge on the image recording member.

2. The apparatus of claim 1 wherein the first operating parameter is primary voltage level on the image recording member and the parameter related to the first operating parameter is running average of the primary voltage setpoint.

3. An electrostatographic recording method comprising:

establishing a uniform electrostatic charge on an image recording member in accordance with a first operating parameter;

imagewise modulating the charge on the image recording member to form electrostatic latent images in accordance with a second operating parameter and forming a developable process control patch;

operating a development station to develop the electrostatic latent images and the control patch on the image recording member with toner in accordance with a third operating parameter;

providing toner to the development station at a controlled rate in accordance with a replenishment signal;

sensing density of the control patch developed by the development station; and in response to density of the control patch providing adjustments to the first, second and third operating parameters and controlling a reference signal used to generate the replenishment signal as a function of a parameter related to one of the first, second or third operating parameters and independent of a reading of a level of the uniform charge on the image recording member.

4. The method of claim 3 wherein the replenishment signal is a function of a parameter related to the first operating parameter.

5. The method of claim 4 wherein the first operating parameter is primary voltage level on the image recording member and the parameter related to the first operating parameter is running average of the primary voltage setpoint.

6. The method of claim 5 wherein the reference signal is adjusted when the running average is determined to be outside of a range of normal operating values for primary voltage setpoint.

7. The method of claim 6 wherein a toner concentration monitor (TCM) has a parametric relationship between a TCM output signal, $V_{MON}$, and a toner concentration related signal that is input to the monitor, and wherein the replenishment signal is generated in response to $V_{MON}$ and the reference signal.

8. The method of claim 6 wherein a toner concentration monitor (TCM) has an adjustable parametric relationship between a TCM output signal, $V_{MON}$, and a toner concentration (TC) related signal that is input to the monitor and wherein $V_{MON}$ is a function of the TC related signal and the reference signal, and the replenishment signal is generated in response to $V_{MON}$.

9. An electrostatographic recording method comprising:

establishing a uniform electrostatic charge on an image recording member in accordance with a first setpoint parameter for controlling a voltage level control of a primary charger;

imagewise modulating the charge on the image recording member to form electrostatic latent images in accordance with a second parameter and forming a developable process control patch;

operating a development station to develop the electrostatic latent images and the control patch on the image recording member with toner in accordance with a third parameter;

providing toner to the development station at a controlled rate in accordance with a replenishment signal;

sensing density of the control patch developed by the development station; and in response to density of the control patch providing adjustments to the first, second and third parameters and controlling a reference signal used to generate the replenishment signal as a function of a running average of the first setpoint parameter and independent of a reading of a level of the uniform charge on the image recording member.

10. The method of claim 9 wherein a toner concentration monitor (TCM) has a parametric relationship between a TCM output signal, $V_{MON}$, and a toner concentration related signal that is input to the monitor, and wherein the replenishment signal is generated in response to $V_{MON}$ and the reference signal.

11. The method of claim 9 wherein a toner concentration monitor (TCM) has an adjustable parametric relationship between a TCM output signal, $V_{MON}$, and a toner concentration (TC) related signal that is input to the monitor and wherein $V_{MON}$ is a function of the TC related signal and the reference signal, and the replenishment signal is generated in response to $V_{MON}$.

* * * * *